US010867781B2

(12) United States Patent
Ramsey et al.

(10) Patent No.: US 10,867,781 B2
(45) **Date of Patent: *Dec. 15, 2020**

(54) ELECTROSPRAY IONIZATION INTERFACE TO HIGH PRESSURE MASS SPECTROMETRY AND RELATED METHODS

(71) Applicant: The University of North Carolina at Chapel Hill, Chapel Hill, NC (US)

(72) Inventors: John Michael Ramsey, Chapel Hill, NC (US); William McKay Gilliland, Jr., Chapel Hill, NC (US)

(73) Assignee: The University of North Carolina at Chapel Hill, Chapel Hill, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/371,213

(22) Filed: Apr. 1, 2019

(65) Prior Publication Data

US 2019/0287781 A1 Sep. 19, 2019

Related U.S. Application Data

(60) Continuation of application No. 15/190,867, filed on Jun. 23, 2016, now Pat. No. 10,249,484, which is a (Continued)

(51) Int. Cl.
*H01J 49/16* (2006.01)
*H01J 49/24* (2006.01)

(Continued)

(52) U.S. Cl.
CPC ..... *H01J 49/165* (2013.01); *H01J 49/0031* (2013.01); *H01J 49/04* (2013.01);

(Continued)

(58) Field of Classification Search
CPC ..... H01J 49/0031; H01J 49/04; H01J 49/165; H01J 49/24; H01J 49/167
See application file for complete search history.

(56) References Cited

U.S. PATENT DOCUMENTS 4,669,298 A 6/1987 Kono et al.
5,115,131 A * 5/1992 Jorgenson ..... H01J 49/165 250/282

(Continued)

FOREIGN PATENT DOCUMENTS

WO WO 2003/086589 10/2003
WO WO 2004/085992 10/2004

OTHER PUBLICATIONS

Baker et al., Recent advances in microfluidic detection systems, Bioanalysis, Aug. 2000, pp. 967-975, vol. 1, No. 5.

(Continued)

*Primary Examiner* — Wyatt A Stoffa
(74) *Attorney, Agent, or Firm* — Myers Bigel, P.A.

(57) ABSTRACT

An electrospray ionization (ESI)-mass spectrometer analysis systems include an ESI device with at least one emitter configured to electrospray ions and a mass spectrometer in fluid communication with the at least one emitter of the ESI device. The mass spectrometer includes a mass analyzer held in a vacuum chamber. The vacuum chamber is configured to have a high (background/gas) pressure of about 50 mTorr or greater during operation. During operation, the ESI device is configured to either; (a) electrospray ions into a spatial region external to the vacuum chamber and at atmospheric pressure, the spatial extent being adjacent to an inlet device attached to the vacuum chamber, the inlet device intakes the electrosprayed ions external to the vacuum chamber with the mass analyzer and discharges the ions into the vacuum chamber with the mass analyzer; or (b) electro- (Continued)

spray ions directly into the vacuum chamber with the mass analyzer.

15 Claims, 21 Drawing Sheets

Related U.S. Application Data division of application No. 14/710,344, filed on May 12, 2015, now Pat. No. 9,406,492.

(51) Int. Cl.
*H01J 49/00* (2006.01)
*H01J 49/04* (2006.01)
*B01L 3/00* (2006.01)

(52) U.S. Cl.
CPC ..... *H01J 49/167* (2013.01); *H01J 49/24* (2013.01); *B01L 3/502715* (2013.01)

(56) References Cited

U.S. PATENT DOCUMENTS 6,107,628 A 8/2000 Smith et al.
6,259,091 B1 7/2001 Eiden et al.
6,458,597 B1 * 10/2002 Andrien, Jr. ..... H01J 49/0445 250/281
6,469,298 B1 * 10/2002 Ramsey ..... H01J 49/0018 250/281
6,586,731 B1 * 7/2003 Jolliffe ..... H01J 49/049 250/281
6,933,498 B1 8/2005 Whitten et al.
7,351,964 B2 4/2008 Tolmachev et al.
7,435,952 B2 * 10/2008 Finlay ..... H01J 49/0013 250/292
7,767,959 B1 * 8/2010 Freidhoff ..... H01J 49/0018 250/288
8,525,111 B1 * 9/2013 Brown ..... H01J 49/24 250/289
8,840,037 B2 * 9/2014 Stark ..... H01J 49/165 239/3
8,878,127 B2 11/2014 Ramsey et al.
9,006,648 B2 4/2015 Ramsey
10,249,484 B2 * 4/2019 Ramsey ..... H01J 49/165
2002/0027197 A1 * 3/2002 Duholke ..... H01J 49/165 250/288
2002/0096631 A1 * 7/2002 Andrien, Jr. ..... H01J 49/0431 250/288
2005/0109948 A1 * 5/2005 Park ..... H01J 49/167 250/425
2006/0076505 A1 * 4/2006 Fischer ..... G01N 30/7253 250/423 P
2006/0151692 A1 7/2006 Collings et al.
2006/0163468 A1 7/2006 Wells et al.
2006/0193748 A1 * 8/2006 Tai ..... G01N 30/34 422/70
2006/0219888 A1 * 10/2006 Jachowski ..... H01J 49/242 250/281
2006/0273251 A1 * 12/2006 Verbeck ..... H01J 49/062 250/281
2007/0252083 A1 * 11/2007 Arscott ..... H01J 49/0018 250/288
2008/0054177 A9 * 3/2008 Andrien, Jr. ..... H01J 49/0445 250/288
2008/0283742 A1 * 11/2008 Takeuchi ..... H01J 49/066 250/288
2009/0095900 A1 * 4/2009 Whitehouse ..... H01J 49/165 250/282
2009/0250608 A1 * 10/2009 Mordehai ..... H01J 49/167 250/288
2011/0036980 A1 * 2/2011 Lisa ..... H01J 49/24 250/288
2011/0105339 A1 5/2011 Moussalami
2012/0199732 A1 * 8/2012 Chetwani ..... H01J 49/165 250/282
2012/0217389 A1 * 8/2012 Zheng ..... H01J 49/165 250/288
2012/0298853 A1 * 11/2012 Kurulugama ..... H01J 49/044 250/282
2013/0043382 A1 * 2/2013 Berkout ..... H01J 49/063 250/282
2013/0056633 A1 * 3/2013 Hashimoto ..... H01J 49/0013 250/288
2013/0120894 A1 5/2013 van Amerom et al.
2013/0280819 A1 * 10/2013 Cooks ..... H01J 49/4205 436/173
2013/0327936 A1 * 12/2013 Ramsey ..... H01J 49/165 250/282
2014/0183355 A1 * 7/2014 Bartfay-Szabo .... H01J 49/0022 250/290
2014/0217281 A1 8/2014 Krutchinsky et al.
2014/0263999 A1 9/2014 Ramsey et al.
2014/0374584 A1 * 12/2014 Stults ..... G16B 40/00 250/282
2015/0136964 A1 * 5/2015 Cooks ..... H01J 49/10 250/281
2015/0200083 A1 * 7/2015 Brown ..... H01J 49/24 250/282
2015/0340218 A1 * 11/2015 Papanastasiou .... H01J 49/0495 250/289

OTHER PUBLICATIONS

Bantscheff et al., Quantitative mass spectrometry in proteomics: a critical review, Anal Bioanal Chem, 2007, pp. 1017-1031, vol. 389.
Batz et al., Chemical Vapor Deposition of Aminopropyl Silanes in Microfuidic Channels for Highly Efficient Microchip Capillary Electrophoresis-Electrospray Ionization-Mass Spectrometry, Anal. Chem., 2014, pp. 3493-3500, vol. 86.
Chambers et al., Monolithic Integration of Two-Dimensional Liquid Chromatography-Capillary Electrophoresis and Electrospray Ionization on a Microfluidic Device, Anal. Chem., 2011, pp. 842-849, vol. 83.
Cox et al., Improving the Sensitivity of Mass Spectrometry by Using a New Sheath Flow Electrospray Emitter Array at Subambient Pressures, J. Am. Soc. Mass Spectrom., 2014, pp. 2028-2037, vol. 25.
Cox et al. On the Ionization and Ion Transmission Efficiencies of Different ESI-MS Interfaces, J. Am. Soc. Mass Spectrom., 2015, pp. 55-62, vol. 26.
Dittrich et al., Micro Total Analysis Systems. Latest Advancements and Trends, Anal. Chem., 2006, pp. 3887-3907, vol. 78, No. 12.
Domon et al., Mass Spectrometry and Protein Analysis, Science, 2006, pp. 212-217, vol. 312.
Felten et al., Automated High-Throughput Infusion ESI-MS with Direct Coupling to a Microtiter Plate, Anal. Chem., 2001, pp. 1449-1454, vol. 73, No. 7.
Gao et al., Design and Characterization of a Multisource Hand-Held Tandem Mass Spectrometer, Anal. Chem., 2008, pp. 7198-7205, vol. 80, No. 19.
Gonzalez et al., Advanced liquid chromatography-mass spectrometry (LC-MS) methods applied to wastewater removal and the fate of surfactants in the environment, Trends in Anal. Chem., 2007, pp. 116-124, vol. 26, No. 2.
Hernandez et al., Antibiotic reidue determination in environmental waters by LC-MS, Trends in Analytical Chemistry, 2007, pp. 466-485, vol. 26, No. 6.
Ho et al., Electrospray Ionisation Mass Spectrometry: Principles and Clinical Applications, Clin Biochem Rev, 2003, pp. 3-12, vol. 24.
Hong et al., Monitoring Cell Culture Media With the Waters Amino Acid Analysis Solution, Application Note, Waters Corporation, 2007, 4 pages.
Honour, Benchtop mass spectrometry in clinical biochemistry, Ann Clin Biochem, 2003, pp. 628-638, vol. 40.

(56) References Cited

OTHER PUBLICATIONS

International Search Report and Written Opinion for related PCT Application No. PCT/US2015/030380, dated Apr. 22, 2016, 19 pages.
Julian et al., Ion Funnels for the Masses: Experiments and Simulations with a Simplified Ion Funnel, J Am Soc Mass Spectrom, 2005, pp. 1708-1712, vol. 16.
Kameoka et al., An Electrospray Ionization Source for Integration with Microfluidics, Anal. Chem., 2002, pp. 5897-5901, vol. 74, No. 22.
Kim et al., Design and Implementation of a New Electodynamic Ion Funnel, Anal. Chem., 2000, pp. 2247-2255, vol. 72, No. 10.
Lazar et al., Subattomole-Sensitivity Microchip Nanoelectrospray Source with Time-of-Flight Mass Spectrometry Detection, Anal. Chem., 1999, pp. 3627-3631, vol. 71, No. 17.
Lazar et al., Novel microfabricated device for electrokinetically induced pressure flow and electrospray ionization mass spectrometry, Journal of Chromatography A, 2000, pp. 195-201, vol. 892.
Li, et al., Separation and Identification of Peptides from Gel Isolated Membrane Proteins Using a Microfabricated Device for Combined Capillary Electrophoresis/Nanoelectrospray Mass Spectrometry, Anal. Chem., 2000, pp. 599-609, vol. 72, No. 3.
Licklider et al., A Micromachined Chip-Based Electrospray Source for Mass Spectrometry, Anal. Chem., 2000, pp. 367-375, vol. 72, No. 2.
Marginean et al., Achieving 50% Ionization Efficiency in Subambient Pressure Ionization with Nanoelectrospray, Anal. Chem., 2010, pp. 9344-9349, vol. 82, No. 22.
Mellors et al., Fully Integrated Glass Microfluidic Device for Performing High-Efficiency Capillary Electrophoresis and Electrospray Ionization Mass Spectrometry, Anal. Chem., 2008, pp. 6881-6887, vol. 80, No. 18.
Misharin et al., Development and Characterization of a Field-Deployable Ion-Trap Mass Spectrometer with an Atmospheric Pressure Interface, Anal. Chem., 2012, pp. 10105-10112, vol. 84.
Ouyang et al., Miniature Mass Spectrometers, Annu. Rev. Anal. Chem., 2009, pp. 187-214, vol. 2.
Page et al., Subambient Pressure Ionization with Nanoelectrospray Source and Interface for Improved Sensitivity in Mass Spectrometry, Anal. Chem., 2008, pp. 1800-1805, vol. 80, No. 5.
Page et al., Ionization and Transmission Efficiency in an Electrospray Ionization-Mass Spectrometry Interface, J Am Soc Mass Spectrom, 2007, pp. 1582-1590, vol. 18.
Pioch et al., Capillary electrophoresis/mass spectrometry relevant to pharmaceutical and biotechnological applications, Electrophoresis, 2012, pp. 1517-1530, vol. 33.
Ramsey et al., Generating Electrospray from Microchip Devices Using Electroosmotic Pumping, Anal. Chem., 1997, pp. 1174-1178, vol. 69, No. 6.
Shaffer et al., A Novel Ion Funnel for Focusing Ions at Elevated Pressure Using Electrospray Ionization Mass Spectrometry, Rapid Communications in Mass Spectrometry, 1997, pp. 1813-1817, vol. 11.
Svedberg et al., Sheathless Clectrospray from Polymer Microchips, Anal. Chem., 2003, pp. 3934-3940, vol. 75, No. 15.
Tang et al., Improving Liquid Chromatography-Mass Spectrometry Sensitivity Using a Subambient Pressure Ionization with Nanoelectrospray (SPIN) Interface, J. Am. Soc. Mass Spectrom., 2011, pp. 1318-1325, vol. 22.
Whitehouse et al., Electrospray Interface for Liquid Chromatographs and Mass Spectrometers, Anal. Chem., 1985, pp. 675-679, vol. 57, No. 3.
Whitten et al., High-pressure ion trap mass spectrometry, Rapid Communications in Mass Spectrometry, 2004, pp. 1749-1752, vol. 18.
Xue et al., Multichannel Microchip Electrospray Mass Spectrometry, Anal. Chem., 1997, pp. 426-430, vol. 69, No. 3.
Zhang et al., High-Throughput Microfabricated CE/ESI-MS: Automated Sampling from a Microwell Plate, Anal. Chem., 2001, pp. 2675-2681, vol. 73, No. 11.

* cited by examiner

P = 1.3 Torr, AMBIENT AIR
SOLUTION: 100 μM S AND W; 50 μM M
BGE: 50% ACN, 0.1 % FORMIC ACID SOLUTION: 5 μM THYMOPENTIN (RKDVY)
P = 1.3 Torr, AMBIENT AIR $r_0$ = 250 μm
$z_0$ = 250 μm $$\frac{m}{\Delta m} \alpha \frac{\Omega}{p}$$

m = ION MASS
$\Omega = 2\pi f$, f = RF DRIVE FREQUENCY
P = BUFFER GAS PRESSURE $$\left(\frac{m}{e}\right)_{max} = \frac{8V_{max}}{q_{max}\Omega^2 (r_0^2 + 2z_0^2)}$$

e = ELEMENTARY CHARGE
$V_{max}$ = RF AMPLITUDE (0-p)
$q_{max}$ = TRAPPING PARAMETER, ≤ 0.908

ELECTROSPRAY IONIZATION INTERFACE TO HIGH PRESSURE MASS SPECTROMETRY AND RELATED METHODS

RELATED APPLICATIONS

This application is a continuation application of U.S. patent application Ser. No. 15/190,867, filed Jun. 23, 2016, which is a divisional application of U.S. patent application Ser. No. 14/710,344, filed May 12, 2015, the contents of which are hereby incorporated by reference as if recited in full herein.

STATEMENT OF GOVERNMENT SUPPORT

This invention was made with government support under grant number W911NF-12-1-0539 awarded by the U.S. Army Research Office. The United States government has certain rights in the invention.

FIELD OF THE INVENTION

This invention is related to mass spectrometry and is particularly suitable for high pressure mass spectrometers.

BACKGROUND OF THE INVENTION

Mass spectrometry (MS) is a powerful analytical technique due to its sensitivity, versatility, and ability to provide chemical and structural information of molecules; because of this, it is often the detection method of choice for a wide range of applications. Electrospray ionization (ESI) has significantly expanded the range of mass spectrometric analysis to include biomolecules and other liquid-borne analytes. ESI provides a facile method for coupling liquid phase separations, such as liquid chromatography (LC) or capillary electrophoresis (CE) with MS detection. As a result, LC-MS has become a widely used analytical tool in fields such as proteomics, environmental monitoring, drug discovery and development, and clinical diagnostics. However, conventional LC-MS systems are usually confined to dedicated laboratories because they are large, expensive, complex, and require significant amounts of power. Conventional mass spectrometers are unsuitable for these situations because of their large size, weight, and power consumption (SWaP). See, e.g., Whitten et al., *Rapid Commun. Mass Spectrom.* 2004, 18, 1749-52. Miniaturization of LC-MS systems is limited by the need for a rugged system of pumps, valves, and tubing, while mass spectrometers are limited by low pressure operation, which have conventionally required bulky, fragile, and expensive turbomolecular pumps.

One of the difficulties associated with coupling ESI sources with MS systems is that ions must be transported into vacuum for mass analysis. See, e.g., Page J. S., et al. "Ionization and Transmission Efficiency in an Electrospray ionization—mass Spectrometry Interface." *J. Am. Soc. Mass. Spec.,* 2007, 18(9), 1582-1590. The transmitted ion current from an ESI source through a capillary inlet system can be reduced by up to three orders of magnitude. These losses occur mostly in transfer regions from a higher pressure to lower pressure (i.e. on either side of a capillary inlet) and two or more of these regions are typically used in traditional ESI-MS. See, e.g., S. A. Shaffer, K. Tang, G. A. Anderson, D. C. Prior, H. R. Udseth, R. D. Smith. *Rapid Communications in Mass Spectrometry,* 1997, 11, 1813-1817. This presents a significant challenge for coupling ESI with HPMS.

SUMMARY OF EMBODIMENTS OF THE INVENTION

Embodiments of the invention provide an electrospray ionization device coupled with high pressure mass spectrometry (HPMS). The mass spectrometer can have an atmospheric conductive inlet that is in electrical communication with a direct current power supply to conduct ions into the mass spectrometer from the ESI device. The HPMS can have a single or dual chamber configuration. A mass analyzer, such as a miniature cylindrical ion trap (mini-CIT), can reside in a vacuum chamber of a single or dual vacuum chamber design.

Embodiments of the invention are directed to electrospray ionization (ESI)-mass spectrometer analysis systems. The systems include an ESI device with at least one emitter configured to electrospray ions and a mass spectrometer in fluid communication with the at least one emitter of the ESI device. The mass spectrometer includes a mass analyzer held in a vacuum chamber. The vacuum chamber is configured to have a high (background/gas) pressure of about 50 mTorr or greater (by way of example, about 1 Torr, about 2 Torr, about 10 Torr or about 100 Torr) during operation. The mass spectrometer also includes a detector in communication with the mass analyzer. During operation, the ESI device is configured to either; (a) electrospray ions into a spatial region external to the vacuum chamber and at atmospheric pressure adjacent to an inlet device attached to the vacuum chamber; or (b) electrospray ions directly into the vacuum chamber with the mass analyzer. For (a), the inlet device intakes the electrosprayed ions external to the vacuum chamber with the mass analyzer and discharges the ions into the vacuum chamber with the mass analyzer The detector can be held in the vacuum chamber with the mass analyzer.

The detector can be spaced apart from the mass analyzer in the vacuum chamber by a distance of about 1 to about 10 mm.

The ESI device can be configured to electrospray ions into the spatial region external to the vacuum chamber. The ESI device can be positioned external to the vacuum chamber with the mass analyzer. The inlet device can be spaced apart from the ESI device. An end portion of the inlet device can reside inside the vacuum chamber with the mass analyzer to be spaced apart from an ion entrance of the mass analyzer by a distance that is between 1-50 mm.

The inlet device can be tubular with at least one inlet aperture that is in fluid communication with at least one longitudinally extending channel extending therethrough. The system can include a direct current voltage input to the inlet device external to the vacuum chamber with the mass analyzer.

The ESI device can be configured to electrospray ions into the spatial region external to the vacuum chamber. The inlet device can include at least one inlet aperture and can have an external end that is spaced apart from the ESI device. The inlet device can be planar, conductive and have a thickness that is between about 0.100 mm and about 5 mm.

The system can include a compartment that holds the ESI device in an orientation and position for cooperating alignment with the inlet device. The compartment can include a buffer gas, so that, during operation, buffer gas can be transmitted into the vacuum chamber with the mass analyzer via the inlet device.

The ESI device can be configured to electrospray ions directly into the vacuum chamber with the mass analyzer. The ESI device can be attached to a wall of the vacuum chamber with the at least one emitter inside the vacuum chamber and one or more reservoirs of the ESI device are external to the vacuum chamber.

The at least one emitter can be spaced apart from an entrance aperture of the mass analyzer a distance of between 1-50 mm.

The ESI device can include a fluidic microchip with the at least one emitter. The at least one emitter can be positioned in the vacuum chamber with the mass analyzer and is spaced apart from an entrance aperture of the mass analyzer a distance of between about 1-50 mm.

During operation, the wall of the vacuum chamber can be held at an electrical ground potential.

Only a portion of the fluidic microchip may reside in the vacuum chamber with the mass analyzer.

The ESI device can be configured to electrospray ions into the spatial region external to the vacuum chamber at atmospheric pressure adjacent the inlet device and the at least one emitter can be spaced apart from an end of the inlet device that is external to the vacuum chamber by a distance between about 1-10 mm.

The ESI device can be configured to electrospray ions into the spatial region external to the vacuum chamber. The system can include direct current (DC) power supply connected to the inlet device at a location that is external to the vacuum chamber.

The system can include a power supply configured to apply electrokinetic inputs to the ESI device during operation and a vacuum pump in communication with the vacuum chamber with the mass analyzer.

The mass analyzer can include an ion trap with an injector endcap electrode, a ring electrode and an ejector endcap electrode. The vacuum chamber with the mass analyzer can be held at a gas pressure of between 100 mTorr and 10 Torr during operation.

The inlet device can have an external conical shaped tip with at least one inlet aperture.

The at least one emitter can be spaced apart from an entrance aperture of the mass analyzer a distance of between 1-10 mm.

The system can include a tube or ion funnel electrode assembly in the vacuum chamber with the mass analyzer.

The mass analyzer can include an ion trap mass analyzer that is either: (a) a cylindrical ion trap (CIT) with at least one of dimensions $r_0$ or $z_0$ less than about 1 mm; or (b) a Stretched Length Ion Trap (SLIT) with a central electrode having an aperture which extends along a longitudinal direction and the central electrode that surrounds the aperture in a lateral plane perpendicular to the longitudinal direction to define a transverse cavity for trapping charged particles. The aperture in the central electrode can be elongated in a lateral plane, having a ratio of a major dimension to a minor dimension that is greater than 1.5.

Optionally, the minor dimension can be less than 10 mm, which can be about 1 mm or less and/or the transverse cavity can have a vertical dimension $z_0$ that is less than about 1 mm.

The mass analyzer can be a cylindrical ion trap (CIT) with dimensions $r_0$ between about 500 μm and about 100 μm.

The system can include a focusing electrode residing in the vacuum chamber with the mass analyzer.

Other embodiments are directed to methods of analyzing a sample. The methods include: introducing sample ions into a vacuum chamber enclosing a mass analyzer by: (a) electrospraying ions from an electrospray ionization (ESI) device directly into the vacuum chamber with the mass analyzer, with a gas pressure in the mass analyzer being between 50 mTorr and 100 Torr; or (b) electrospraying ions into a spatial region external to the vacuum chamber and at atmospheric pressure, adjacent to an inlet device that is spaced from the ESI device, and then transporting the ions through the inlet device into the vacuum chamber holding the mass analyzer, wherein a gas pressure in the mass analyzer is between 50 mTorr and 100 Torr. The methods also include trapping the ions in the mass analyzer; selectively ejecting the ions from the mass analyzer; detecting electrical signals corresponding to the ejected ions using at least one detector; and generating data based on the detected electrical signals to determine information about the sample.

The electrospraying is carried out from a tip of a microfluidic device having at least one electrospray emitter used to electrospray the ions.

The inlet device is attached to a wall of the vacuum chamber and can have an internal end portion that is positioned within the vacuum chamber and is between about 1 mm and about 50 mm from an entrance aperture of the mass analyzer.

The mass analyzer can include a miniature cylindrical ion trap (CIT), and the mass analyzer and detector can both be held in the vacuum chamber together (not requiring separate vacuum chambers).

The method can include transmitting air as buffer gas into the vacuum chamber with the electrospraying.

The method can include, at least during electrospraying, holding a wall of the vacuum chamber at an electrical ground potential.

The microfluidic device can be a microfluidic chip that performs step (a) and extends partially into the vacuum chamber to position at least one emitter thereof between 1-50 mm from an entrance aperture of the mass analyzer.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed/claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

DESCRIPTION OF EMBODIMENTS OF THE INVENTION

Figure 1:
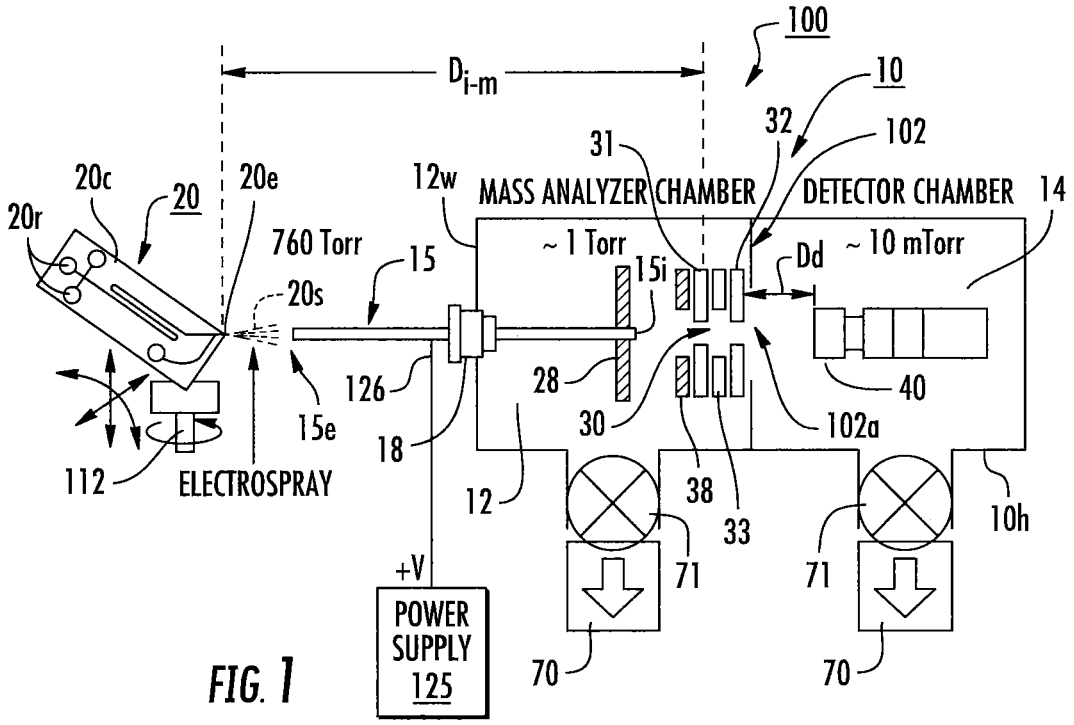
FIG. 1 is a schematic illustration of an exemplary analysis system with a mass spectrometer with an electrospray ionization (ESI) interface according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. In the drawings, the thickness of lines, layers, features, components and/or regions may be exaggerated for clarity and broken lines illustrate optional features or operations, unless specified otherwise. The abbreviations "Fig." and "FIG" are used interchangeably with the word "Figure" in the drawings and specification.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "comprises," "comprising," "includes," and/or "including" when used in this specification, specify the presence of stated features, regions, steps, operations, elements, and/or components, but do not preclude the presence or addition of one or more other features, regions, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when a feature, such as a layer, region or substrate, is referred to as being "on" another feature or element, it can be directly on the other feature or element or intervening features and/or elements may also be present. In contrast, when an element is referred to as being "directly on" another feature or element, there are no intervening elements present. It will also be understood that, when a feature or element is referred to as being "connected", "attached" or "coupled" to another feature or element, it can be directly connected, attached or coupled to the other element or intervening elements may be present. In contrast, when a feature or element is referred to as being "directly connected", "directly attached" or "directly coupled" to another element, there are no intervening elements present. Although described or shown with respect to one embodiment, the features so described or shown can apply to other embodiments.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the present application and relevant art and should not be interpreted in an idealized or overly formal sense unless expressly so defined herein. Well-known functions or constructions may not be described in detail for brevity and/or clarity.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The term "about" means that the stated number can vary from that value by +/−10%.

The term "analyte" refers to a molecule or chemical(s) in a sample undergoing analysis. The analyte can comprise chemicals associated with any industrial products, processes or environments or environmental hazards, toxins such as toxic industrial chemicals or toxic industrial materials, organic compounds, and the like. Moreover, analytes can include biomolecules found in living systems or manufactured such as biopharmaceuticals.

The term "buffer gas" refers to any gas or gas mixture that has neutral atoms such as air, nitrogen, helium, hydrogen, argon, and methane, by way of example.

The term "mass resonance scan time" refers to mass selective ejection of ions from the ion trap with associated integral signal acquisition time.

The term "mass" is often inferred to mean mass-to-charge ratio and its meaning can be determined from context. When this term is used when referring to mass spectra or mass spectral measurements, it is implied to mean mass-to-charge ratio measurements of ions.

The term "microscale" with respect to ion trap mass analyzers refers to miniature sized ion traps with a critical dimension that is in the millimeter to submillimeter range, typically with associated apertures in one or more electrodes of the ion trap having a critical dimension between about 0.001 mm to about 5 mm, and any sub-range thereof. The ion trap electrode central aperture can take on different geometries such as a cylindrical or slit shaped void and arrays of voids are possible.

The terms "miniature cylindrical ion trap", "miniature CIT" and "mini-CIT" refer to a cylindrical ion trap "CIT" with a critical dimension that is in the millimeter to submillimeter range, typically with associated apertures in one or more electrodes of the ion trap having a critical dimension between about 0.001 mm to about 5 mm, and any sub-range thereof. The ion trap electrode central aperture can take on different geometries such as a cylindrical or slit shaped void and arrays of voids are possible.

The term "microfluidic chip" is used interchangeably with "microchip" and refers to a fluidic sample processing device with sub-millimeter sized fluidic channels with at least one integrated emitter for processing samples.

Mass spectrometry has historically been performed under conditions of high vacuum. The reason for this condition is that performance is enhanced if ions do not collide with background gas molecules during their trajectory from an ion source through a mass analyzer arriving at a detector. Ion-molecule collision events scatter the ions away from their intended trajectory, often degrading mass resolution and signal strength. The vacuum that achieves sufficient resolution in conventional systems can be formalized through the Knudsen number, Kn. Mass spectrometry is typically performed in the molecular flow regime defined as Kn>1, and in conventional practice, Kn is between about 100 and over 10,000 for mass analyzers of mass spectrometers.

Table 1 below includes the calculated mean free path (mfp) for helium and nitrogen at a range of pressures from $10^{-6}$-760 Torr. Collision cross sections for helium and nitrogen are determined from the van der Walls volumes of each and average collisional radii used in the mfp calculations are 0.14 nm and 0.18 nm respectively. See, e.g., Knapman, et al, *Intl. J. Mass Spectrom.*, 2010, 298, 17-23, the contents of which are hereby incorporated by reference as if recited in full herein. The mfp values were calculated from Equation 1, where k is Boltzmann's constant, T is temperature in Kelvin, d is the collision diameter, and P is the gas pressure. A temperature of 300K is assumed in Table 1.

$$mfp = \frac{kT}{\sqrt{2}\pi d^2 P} \quad \text{Equation 1}$$

A pressure of $10^{-6}$ Torr or lower is a typical operating pressure of a linear quadrupole or time of flight mass analyzer and the critical length scale is of the order of 100 mm. Such values lead to Kn numbers of several hundred. A typical operational pressure of an ion trap mass spectrometer with a ring electrode radius of 10 mm is about $10^{-4}$ Torr, leading to Kn numbers of about 100. The operating regime of primary interest for embodiments of the present application are pressures greater than 50 mTorr and critical length scales, $z_0$ values, or, for certain trap configurations, $r_0$ values, of less than 1 mm. In all of these cases listed in Table 1, Kn is less than 10 and all but one example is less than unity.

TABLE 1

Knudsen number in microscale traps operated at high pressure

| Pressure (Torr) | mfp (mm) | | L (mm) | Kn (He) | Kn($N_2$) |
|---|---|---|---|---|---|
| 0.000001 | 88920 | 53960 | 100 | 889.20 | 539.60 |
| 0.0001 | 889 | 540 | 10 | 88.92 | 53.96 |
| 0.01 | 8.9 | 5.4 | 1 | 8.89 | 5.40 |
| 0.1 | 0.89 | 0.54 | 1 | 0.89 | 0.54 |
| 0.5 | 0.18 | 0.11 | 0.5 | 0.36 | 0.22 |
| 1 | 0.089 | 0.054 | 0.25 | 0.356 | 0.216 |
| 10 | 0.0089 | 0.0054 | 0.1 | 0.089 | 0.054 |
| 760 | 0.000117 | 0.000071 | 0.01 | 0.012 | 0.007 |

Embodiments of the present invention perform mass spectrometry under unconventional conditions where Kn has values near unity and below (less than 10 and less than 1, for example). At such pressures and fundamental length scales, the mean free path is similar to, or less than, the critical experimental length scale. Embodiments of the invention maybe particularly suitable for Paul trap mass analyzers, commonly referred to as ion trap mass analyzers, that have fundamental length scales that are less than 1 mm, e.g., the radius of the ring electrode, $r_0$, is 1 mm or less. Embodiments of the invention are directed to high-pressure mass spectrometers that can be operated at pressures of 50 mTorr and above (e.g., to 1 Torr, 10 Torr, 100 Torr or 1000 Torr, for example) and/or with Kn values of less than about 10, or even than about one.

The term "high resolution" refers to mass spectra that can be reliably resolved to less than 1 Th, e.g., having a line width less than 1 Th (FWHM). "Th" is a Thomson unit of mass to charge ratio.

The high resolution operation may allow the use of monoisotopic mass to identify the substance under analysis. The term "high detector sensitivity" refers to detectors that can detect signals on a low end ranging from 1-100 charges per second.

The term "high pressure" refers to an operational (gas) background pressure in a vacuum chamber holding a mass analyzer at or above about 50 mTorr, such as between about 50 mTorr to about 100 Torr (thus, the high pressure is in the mass analyzer). In some embodiments, the vacuum chamber pressure with a mass analyzer is between about 50 mTorr and about 10 Torr, or between about 50 mTorr to about 1 Torr or about 2 Torr, e.g., at or under 5 Torr. In some embodiments, the high pressure can be about 50 mTorr, about 60 mTorr, about 70 mTorr, about 80 mTorr, about 90 mTorr, about 100 mTorr, about 150 mTorr, about 200 mTorr, about 250 mTorr, about 300 mTorr, about 350 mTorr, about 400 mTorr, about 450 mTorr, about 500 mTorr, about 600 mTorr, about 700 mTorr, about 800 mTorr, about 900 mTorr, about 1000 mTorr, about 1500 Torr or about 2000 Torr.

FIG. 1 is a block diagram of an exemplary analysis system 100 with an electrospray ionization (ESI) device 20 (shown, by way of example only, as a fluidic microchip device) that is in cooperating alignment with a mass spectrometer 10. As is well known, mass spectrometers 10 have three fundamental components: an ion source, a mass analyzer and a detector. These components can take on different forms depending on the type of mass analyzer. As shown in FIG. 1, the ionizer comprises the ESI device 20. The ESI device 20 can have different forms/configurations including microfluidic chips, glass or quartz capillaries, pulled glass or quartz capillaries, metal capillaries and combinations of the same.

The mass analyzer 30 resides in a vacuum chamber 12 held at a high pressure during operation. The mass spectrometer 10 can be a high pressure mass spectrometer that operates without requiring a turbo-pump, allowing for a more compact design relative to conventional high pressure systems. The detector 40 (which may include an electron multiplier and/or another type of detector) resides downstream of the mass analyzer 30. In some embodiments, the mass spectrometer 10 has a housing **10*h* that can have a second vacuum chamber 14 adjacent the first vacuum chamber 12 and separated by partition 102 that can be held at a different pressure from the first chamber 12**, for differential vacuum pumping.

In some embodiments, the first and second vacuum chambers 12, 14 can be held at between 50 mTorr and 100 Torr, with the second vacuum chamber 14 (where used) held at a lower pressure than the first chamber 12. For example, the pressure in vacuum chamber 12 can be about 100 Torr, about 10 Torr, about 1 Torr, about 100 mTorr, or about 50 mTorr, while the second chamber 14 can be held at a lower pressure, such as about 10 mTorr or below. Where differential pumping is used, the second chamber 14 can be held at a pressure that is about 1 (one) or more orders of magnitude less than the first chamber 12. In some embodiments, the pressure differential can be a factor of 100 or more depending on the leak rate between the chambers 12, 14 and the pumping capacity. For example, in certain embodiments, the high pressure chamber 12 can be at about 1 Torr while the lower pressure (higher vacuum) chamber can be at about 10 mTorr.

However, other pressure differences can be used, e.g., the high pressure chamber 12 can operate at 100 Torr with the lower pressure chamber 14 at about 10 mTorr.

While each chamber 12, 14 is shown as being connected to a vacuum pump 70 with a valve 71, in other embodiments a single vacuum pump can be used to provide the differential pressure for the two chambers 12, 14.

As shown in FIG. 1, the mass analyzer 30 can be mounted on the partition 102 that separates vacuum chambers 12 and 14. The partition 102 contains at least one aperture(s) or open space(s) 102*a* fluidly connecting the two chambers 12, 14 which allows transport of buffer gas and ions from vacuum chamber 12 to chamber 14. The pressure drop established by the flow of gas through the aperture(s) 102*a* establishes the differential pressures in the two chambers 12, 14. The mass analyzer 30 can be sealably attached to the partition 102 and can form an enclosed flow path between the two chambers 12, 14. In some embodiments, gas transport through the mass analyzer 30 can be used to enhance ion signals in the case of certain types of ion trap mass spectrometers. See, e.g., U.S. Provisional Application Ser. No. 62/010,050, the contents of which are hereby incorporated by reference as if recited in full herein.

Figure 2:
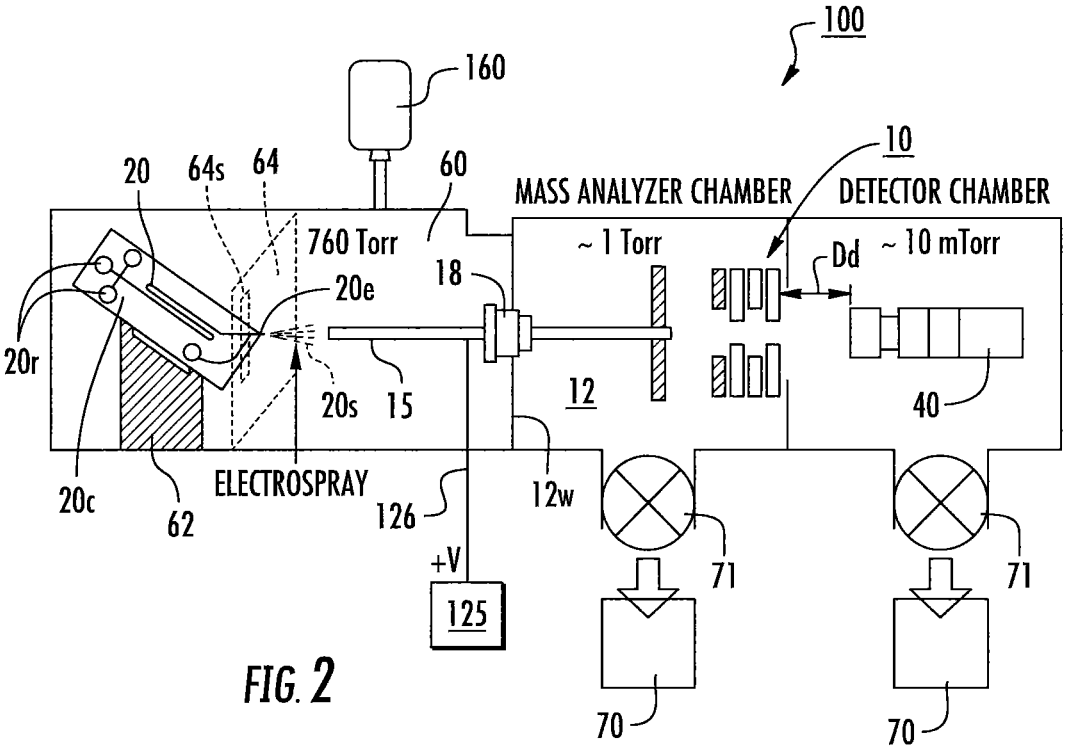
FIG. 2 is a schematic illustration of another embodiment of an exemplary analysis system with an ESI interface according to embodiments of the present invention.
Figure 3A:
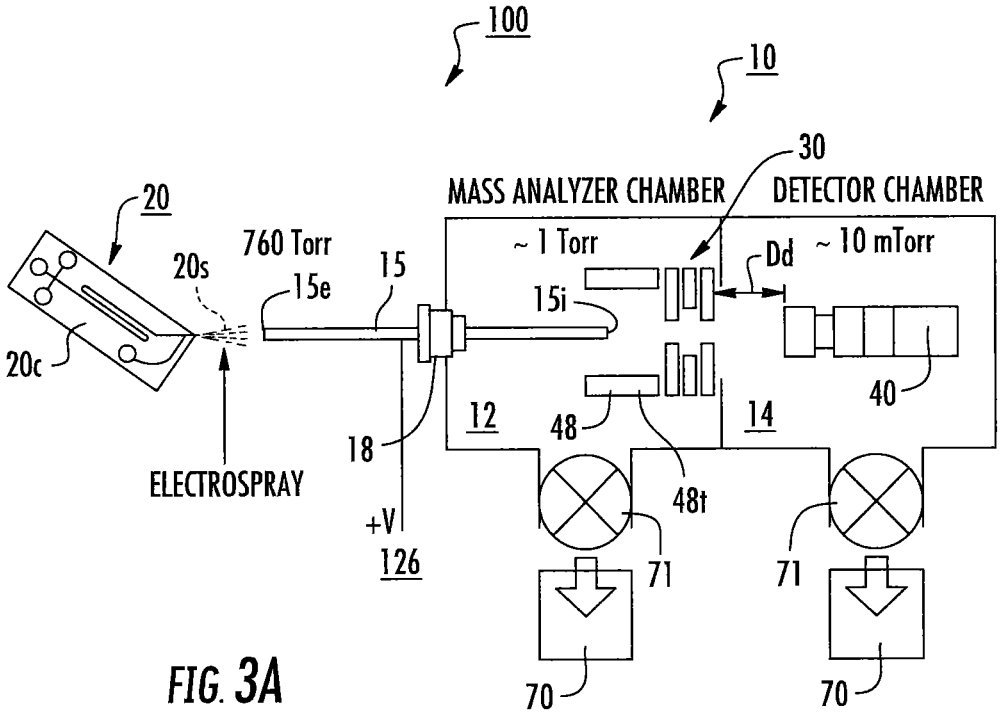
FIGS. 3A-3C are schematic illustrations of other embodiments of an exemplary analysis system with dual vacuum chambers for differential pumping and an ESI interface according to embodiments of the present invention.
Figure 3B:
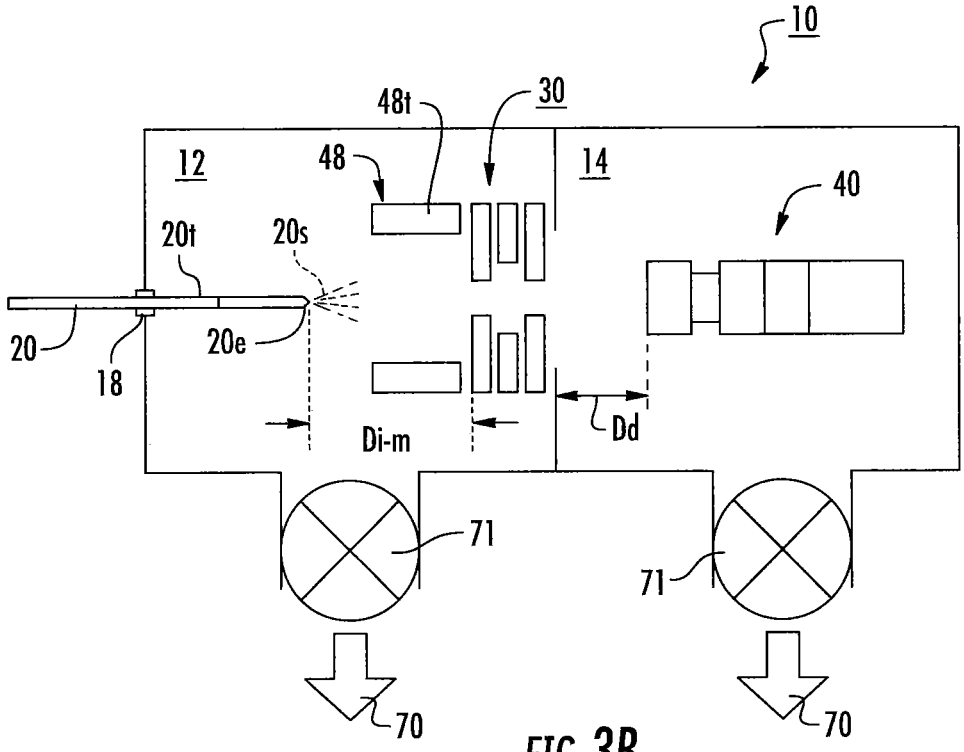

In some embodiments, as shown in FIGS. 1, 2, and 3A, for example, the ESI device 20 can electrospray ion current 20*s* from at least one emitter 20*e* of the ESI device 20 into the inlet device 15, then through the inlet device 15 directly into a mass analyzer chamber 12 at high pressure. The inlet device 15 can be closely spaced apart from or abutting contact with the emitter 20*e*, while the emitter 20*e* discharges, e.g., electrosprays, the sample into a spatial region external to the vacuum chamber 12 at ambient (e.g., atmospheric) pressure then into the inlet tube 15. The electrospray 20*s* can be into ambient (i.e., atmospheric) pressure, then into the inlet aperture 15*a* which is at ambient pressure, then into the vacuum chamber 12 with the mass analyzer 30. The mass analyzer chamber 12 can be in fluid communication with a vacuum pump 70 via a valve 71. The external end 15*e* of the inlet device 15 is at atmospheric pressure, facing the ESI emitter 20*e*, while the mass analyzer vacuum chamber 12 is at a high pressure. The internal end 15*i* of the inlet device 15 is held inside the mass analyzer chamber 12. The inlet device 15 can be sealably attached to a wall 12*w* of the mass analyzer vacuum chamber 12 via a connector 18 such as a vacuum fitting, e.g., an Ultra-Torr™ fitting from Swagelok, Inc., Solon, Ohio.

The emitter 20*e*, as the ion source, can be positioned to provide for a relatively compact footprint. As shown in FIG. 1, the external to internal distance Di-m, measured from the emitter tip 20*e* to the entry of the mass analyzer 30, is typically between about between about 1 cm and about 15 cm, and is more typically between about 5 cm and about 12 cm, such as about 5 cm, about 5.5 cm, about 6 cm, about 6.5 cm, about 7 cm, about 7.5 cm, about 8 cm, about 8.5 cm, about 9 cm, about 9.5 cm, about 10 cm, about 10.5 cm, about 11 cm, about 11.5 cm, and about 12 cm.

In some embodiments, the internal distance, from the end of the device 15 defining the internal inlet 15*i*, can be closely spaced apart from the entry of the mass analyzer 30, to define an internal ion-source to mass analyzer ion entry distance that is between about 1 mm and about 50 mm, between about 1 mm and 40 mm, between about 1 mm and 30 mm, between 1 mm and 20 mm or between about 1 mm and 10 mm. The distance can increase and/or maximize ion transmission without requiring complex ion optics.

In certain embodiments, the inlet device 15 can be conductive and in electrical communication with at least one power supply 125. The inlet device 15 can be stainless steel or other suitable material. As shown, a voltage input 126 from a power supply 125 can be applied to an external segment of the inlet device 15 between a tip of the external end 15*e* and a wall 12*w* of the chamber or wall of a MS housing 10*h* holding the chamber 12. The voltage input 126 can be between about 10 V to about 500 V, more typically between about 100 V to about 250 V, in some embodiments. The voltage applied to the inlet device 15 may vary depending on one or more of the following: length of the input device, position of the inlet device relative to the mass analyzer (e.g., ion trap), analyte of interest, electrospray volume, electrospray pressure and the like. The voltage may have positive or negative polarity depending on, for example, the analyte of interest such as cations versus anions, for example.

The ESI device 20 can be held by an x-y-z stage or other support 112 (FIG. 1) that can allow the device 20 to be placed adjacent the external end of the inlet 15*e*, typically within about 1-50 mm, more typically within about 5-10 mm with a respective at least one device emitter 20*e* in a proper orientation and position. Alternatively or additionally, the support 112 can be configured to rotate for rotational positioning to change an angular orientation of the emitter with respect to the inlet 15*e*.

In some embodiments, preferably at least when using low ESI flow rates, e.g., typically <1 μL/min, the at least one emitter 20*e* can be positioned axially with the inlet 15*e*. In other embodiments, the at least one emitter 20*e* can be above, below and/or to the side of the inlet 15*e*.

In the embodiment shown in FIG. 1, the internal end of the inlet device 15*i* can be in communication with, shown as held by, an electrode 28. The internal end of the inlet device 15*i* and the electrode 28 can be spaced apart from a gate electrode 38 and/or entry of the mass analyzer 30 by between about 1 mm to about 20 mm, more typically between about 1 mm and about 10 mm, such as about 2 mm, about 3 mm, about 4 mm, about 5 mm, about 6 mm, about 7 mm, about 8 mm, about 9 mm and about 10 mm. In some embodiments, the electrode 28 is an accelerating electrode for the ions.

In some embodiments, as shown in FIG. 2, the mass spectrometer 10 can have a holding compartment 60 that holds the ESI device 20. In certain embodiments, the holding compartment 60 can be open to surrounding atmosphere so that air functions as the buffer gas. In some embodiments, the compartment 60 can be enclosed and filled with a buffer gas such as helium, hydrogen or dry nitrogen, for example from a pressurized buffer gas supply container 160. The holding compartment 60 can include a support 62 that can hold the ESI device 20 in a desired (typically adjustable) orientation and position relative to the inlet device 15. The support 62 can be configured as the x-y-z stage 112 or can cooperate with the stage 112. The holding compartment 60 can be configured to enclose the emitter 20*e* and/or the entire ESI device 20 during operation.

In some embodiments, as also shown in FIG. 2, an electrical barrier 64 can be positioned about the ESI device 20 to shield the ESI emitter 20*e* from voltages applied to one or more reservoirs 20*r* on the ESI device 20. A segment, e.g., a length of between about 1-10 mm, of the ESI device 20 with the ESI emitter 20*e* can extend through a slot 64*s* in the barrier 64. The barrier 64 can comprise a single-sided copper clad circuit board (available, for example, from M.G. Chemicals, Burlington, Ontario, Canada), or any other suitable barrier device as known to those of skill in the art. In some embodiments, the barrier 64 can be held at a defined voltage for CE use and at a reference ground potential (GND) for infusion use.

FIGS. 3A-3C and 4A-4C illustrate other examples of an analysis system 100.

Figure 4A:
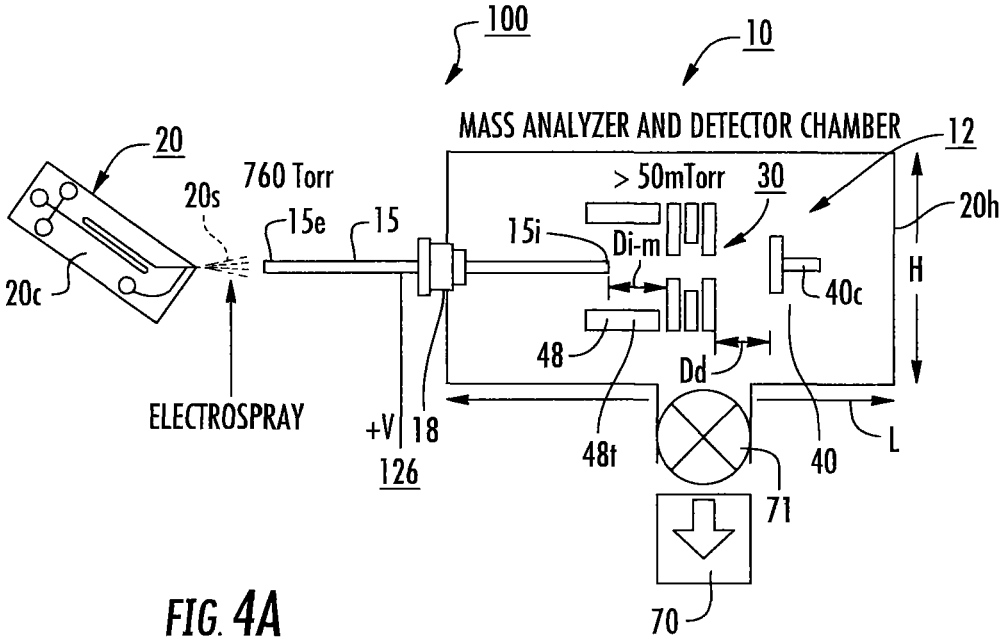
FIGS. 4A-4D are schematic illustrations of other embodiments of an exemplary analysis system with a single vacuum chamber for a mass analyzer and detector with an ESI interface according to embodiments of the present invention.
Figure 4B:
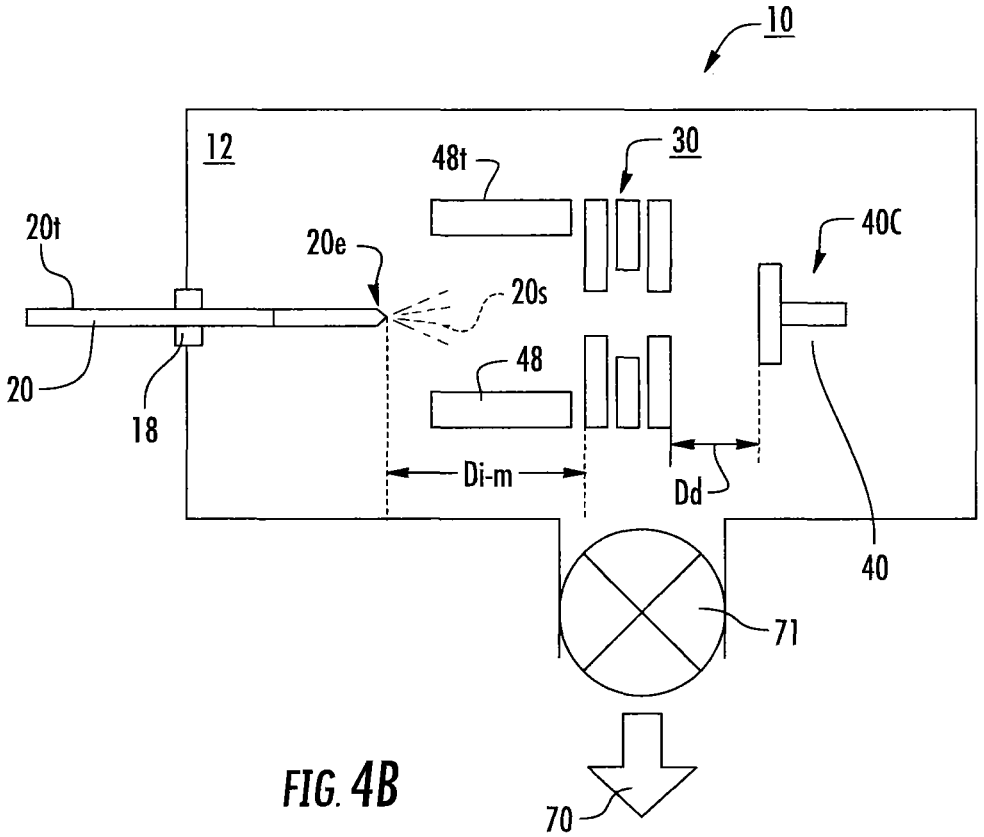

As shown in FIGS. 3A and 4A, for example, the inlet device 15 can extend into a focusing electrode 48, shown as a tube electrode 48*t*, and be used in lieu of the accelerating and gate electrodes 28, 38 shown in FIGS. 1 and 2. The focusing electrode 48 can act as a "lens" to focus the ions into the mass analyzer 30. The focusing electrode 48 can be operated with DC voltages to focus the ions. The focusing electrode 48 can have an inner diameter that is between about 3 and 6 mm and may have a length that is between 3-10 mm, typically about 5 mm. The focusing electrode 48 can be closely spaced apart from the front end of the mass analyzer 30 (e.g., the front endcap electrode of an ion trap), typically by about 0.1 mm to about 2 mm, such as about 0.1 mm, about 0.2 mm, about 0.3 mm, about 0.4 mm, about 0.5 mm, about 0.6 mm, about 0.7 mm, about 0.8 mm, about 0.9 mm, about 1 mm, about 1.1 mm, about 1.2 mm, about 1.3 mm, about 1.4 mm, about 1.5 mm, about 1.6 mm, about 1.7 mm, about 1.8 mm, about 1.9 mm, and about 2 mm, in some embodiments.

In some embodiments, the internal end of the inlet device 15*i* can be positioned to reside inside the focusing electrode 48 a short distance of between about 0.1 mm to about 1 mm, typically between about 0.2 mm, about 0.3 mm, about 0.4 mm or about 0.5 mm, for example.

The internal end 15*i* of the inlet device 15 can be between about 1-50 mm from the front of the mass analyzer 30, e.g., the front endcap of the ion trap. In some embodiments, the internal end of the inlet device 15*i* can reside between about 1-10 mm or between about 1-5 mm from the front of the mass analyzer 30.

Figure 3C:
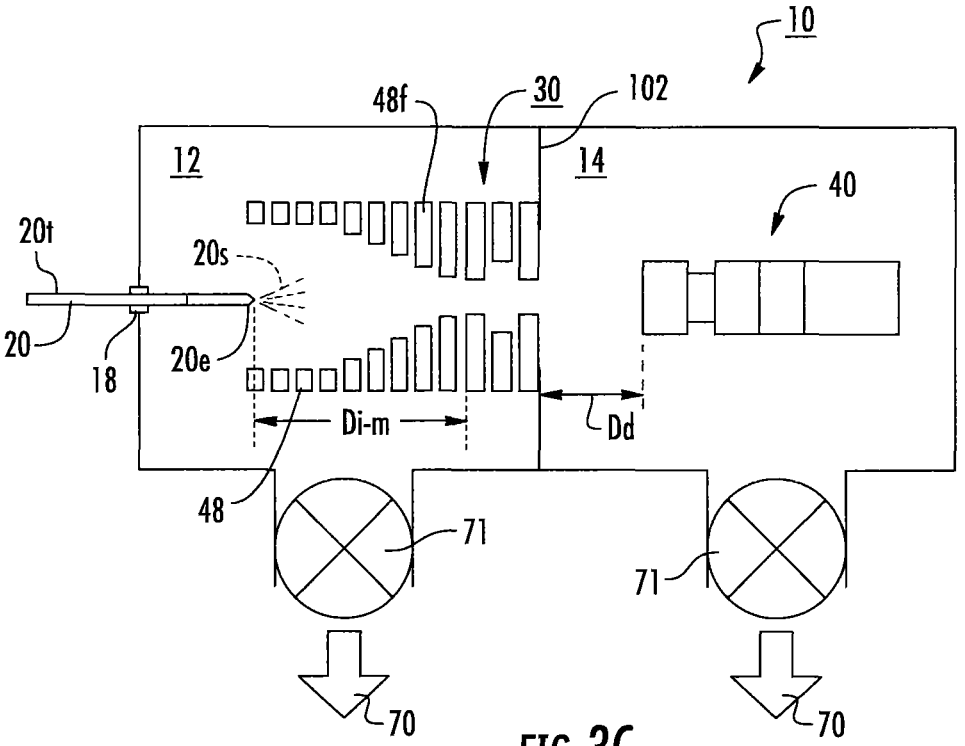
Figure 4C:
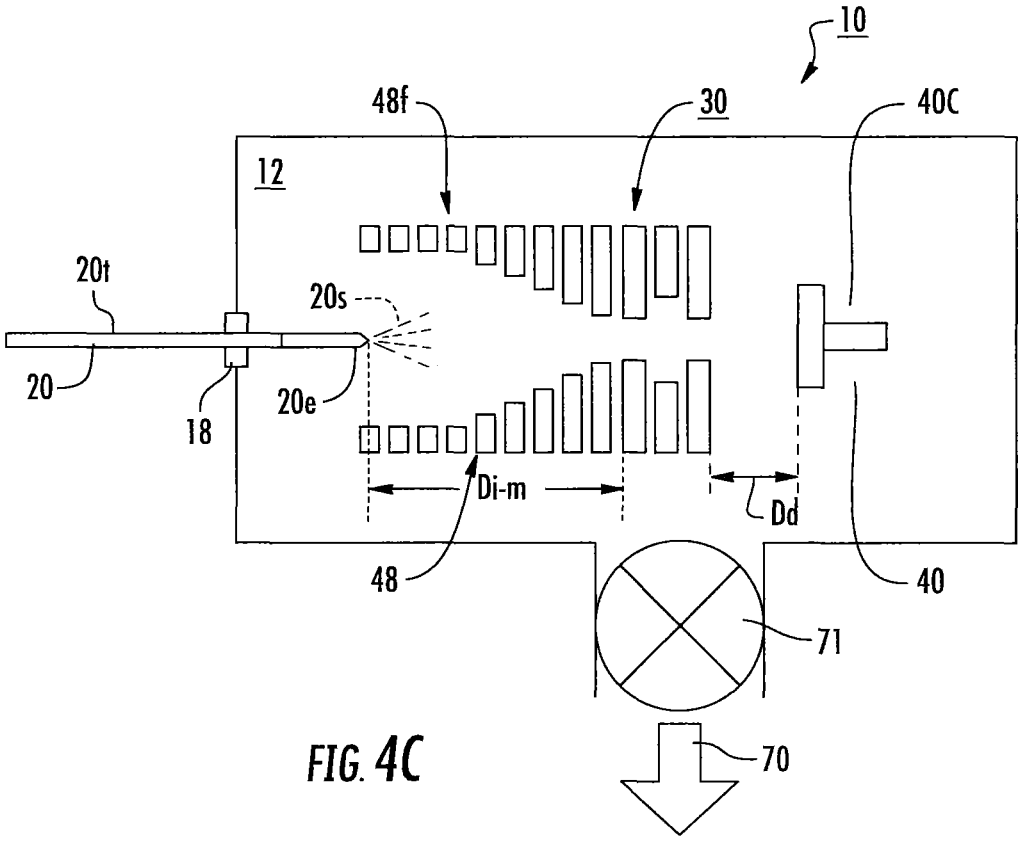

Although shown with the accelerating and gate electrode configurations in FIGS. 1 and 2 and with the focusing electrode 48 as a tube electrode 48*t* in FIGS. 3A and 4A, other focusing/lens electrode arrangements can be used. The discharge end of the inlet tube 15*i* can extend a distance into the focusing lenses and/or electrodes. For example, the focusing electrode 48 can comprise an Einzel lens and/or ion funnel 48*f*. FIGS. 3C and 4C illustrate that the mass spectrometer 10 can have a focusing electrode 48 that comprises an ion funnel electrode 48*f* upstream of the mass analyzer 30 in the vacuum chamber 12 holding the mass analyzer 30.

An accelerating electrode, such as electrode 28 (FIG. 1) is typically electrically connected to the capillary inlet tube 15 and/or capillary ESI device 20*t*, and the field generated accelerates ions toward the mass analyzer 30, e.g., ion trap. The "focusing electrodes" discussed above focus the ions (which may have been accelerated by the "accelerating electrode") into the mass analyzer 30, e.g., ion trap. Thus, the mass spectrometer 10 can include a variety of different ion optic (focusing or "lens" electrode configurations).

Ion funnels 48*f* (FIGS. 3C, 4C) can increase ion transmission by at least an order of magnitude over simple capillary inlets. See, e.g., A. Shaffer, K. Tang, G. A. Anderson, D. C. Prior, H. R. Udseth, R. D. Smith. *Rapid Communications in Mass Spectrometry,* 1997, 11, 1813-1817. An ion funnel typically has a stack of ring electrodes with decreasing inner diameters, using a combination of RF and DC potentials to focus ions. See, e.g., Kim, T.; Tolmachev, A. V.; Harkewicz, R.; Prior, D. C.; Anderson, G.; Udseth, H. R.; Smith, R. D.; *Analytical Chemistry,* 2000, 72, 2247-2255; and Julian, R. R.; Mabbett, S. R.; Jarrold, M. F. *Journal of the American Society for Mass Spectrometry,* 2005, 16 (10), 1708-1712. However, some ion funnels can be planar. See, e.g., US Patent Application Publication Serial Number 2013/0120894, the contents of which are hereby incorporated by reference as if recited in full herein. Ion funnels traditionally operate in a pressure range from 0.1 to 20 Torr. An RF potential is applied to every other electrode ("even electrodes"), and a 180° out-of-phase RF potential of the same magnitude is applied to the other electrodes ("odd electrodes"). A linear DC gradient is applied to both even and odd electrodes, with the highest magnitude voltage being applied to the entrance electrode, and the lowest being applied to the exit electrode. A separate "DC-only" electrode may be placed between the exit of the funnel and the mass analyzer. See, e.g., U.S. Pat. Nos. 6,107,628 and 7,351,964, the contents of which are hereby incorporated by reference as if recited in full herein.

The gate electrode is optional. In some embodiments, the tube electrode 48*t* can have an independent DC voltage applied to it. The ion funnel 48*f* can have a combination of RF and DC potentials applied. When the mass spectrometer 10 includes the tube electrode 48*t*, the tube itself can also function as the gate. When the mass spectrometer 10 includes an ion funnel 48*f*, ions can be gated in several ways (i.e., turning off DC potentials, switching one DC potential and the like).

FIGS. 4A-4D also illustrate that, in some embodiments, the mass spectrometer 10 can have a single chamber 12 holding both the mass analyzer 30 and the detector 40 at a common high pressure. Thus, mass analysis and detection are performed at a single, common high pressure background, e.g., at or >50 mTorr, more typically at or greater than 100 mTorr (such as between about 100 mTorr and 1 Torr, in particular embodiments), optionally with ambient air as the buffer gas. In some embodiments, a holding compartment 60 (FIG. 2) can be used to allow electrospray 20*s* and/or mass spectrometry to be carried out using an alternate buffer gas as noted above.

FIGS. 3A and 4A illustrate that, in some embodiments, the inlet device 15 in communication with the ESI device 20 can electro spray directly into the high pressure chamber 12 holding the mass analyzer 30.

FIGS. 3B, 3C, 4B, 4C and 4D illustrate examples of ESI devices 20 sealed directly to the mass spectrometer 10 (e.g., wall 12*w* of the vacuum chamber 12 holding the mass analyzer 30) with a respective discharge end with emitter 20*e* inside the high pressure vacuum chamber 12 holding the mass analyzer 30 to directly discharge (e.g., electrospray) ions into high pressure without requiring the inlet device 15 shown in FIGS. 3A, 4A, for example.

FIGS. 1, 2, 3A, 4A, 4D, 5A and 5B, for example, illustrate that the ESI device 20 can be a fluidic microchip 20*c*. However, as noted above, other ESI devices 20 may be used. FIGS. 3B, 3C, 4B, and 4C illustrate a capillary tip 20*t* as the ESI emitter 20*e*. The emitter 20*e* is inside the high pressure vacuum chamber 12 with the mass analyzer 30 rather than at atmospheric pressure. In some embodiments, the at least one emitter 20*e* can reside between about 1 mm to about 50 mm, more typically between about 1 mm and 20 mm. The distance can be about 1 mm, about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, and about 20 mm, about 25 mm, about 30 mm, about 35 mm, about 40 mm, about 45 mm or about 50 mm from an ion entry aperture/electrode of the mass analyzer 30.

Figure 4D:
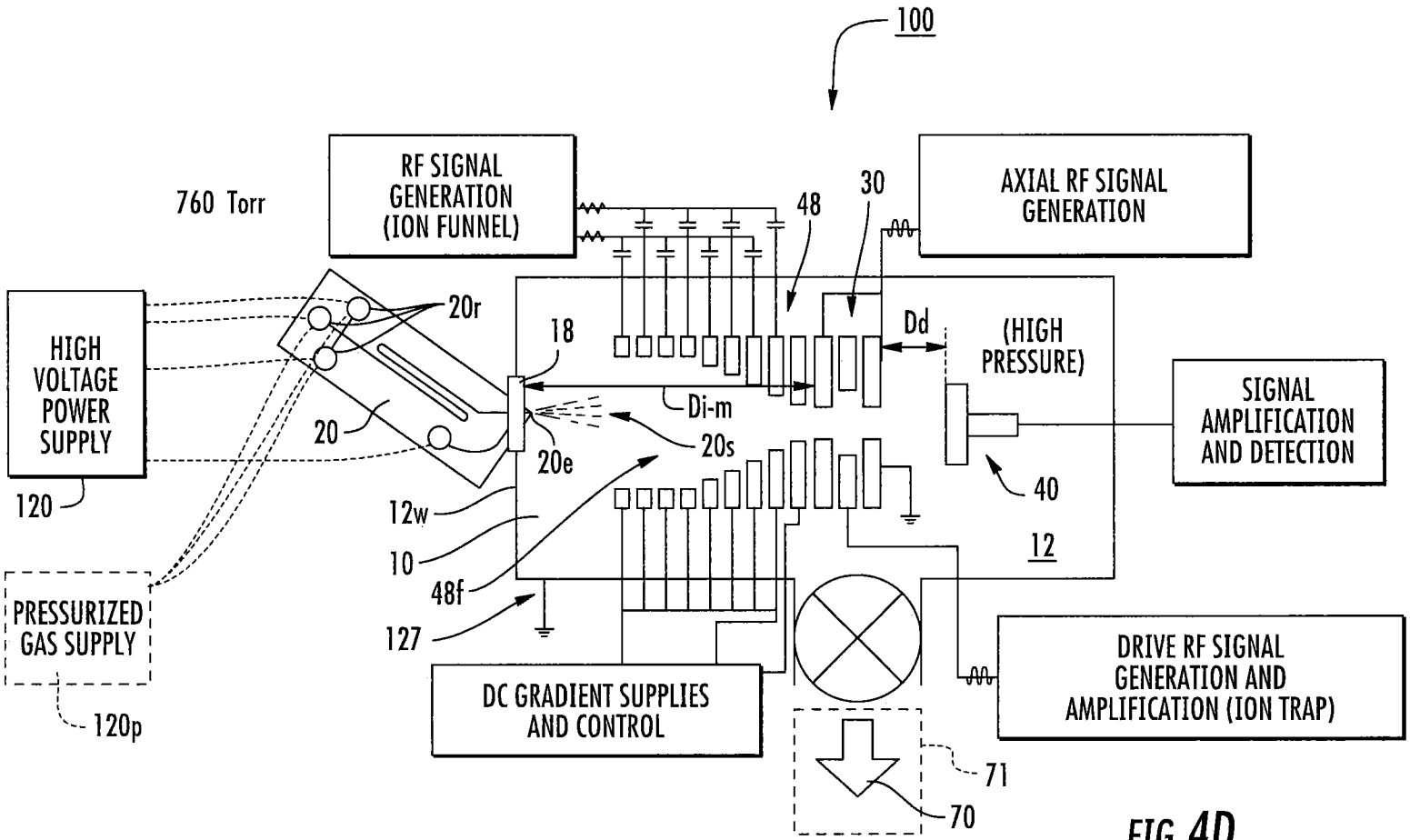

In some embodiments, the ESI device 20 extends into the vacuum chamber 12 with the mass analyzer 30 shown, for example, as a capillary tube 20*t*, in FIGS. 3B, 3C, 4B, 4C, can instead be an ESI microchip 20*c* as shown in FIG. 4D. Thus the microfluidic chip 20*c* can be placed directly into the vacuum 12 without requiring an intermediate inlet device 15. The body of the microchip 20*c* can be sealed to the wall 12*w* of the vacuum chamber 12 holding the mass analyzer 30, so that the at least one emitter 20*e* is in the vacuum and the reservoirs 20*r* are outside of the vacuum chamber 12.

The wall of the vacuum chamber 12*w* can include an aperture for receiving a segment of the microchip 20 via a vacuum seal 18. In some embodiments, the vacuum seal 18 can include an O-ring, gasket or other seal that can extend about an external surface of the microchip 20*c*. The seal 18 may conform to the shape of the microchip 20*c* or segment thereof. In some particular embodiments, the seal 18 can be rectangular. The chip 20 can be oriented horizontally, vertically or even at an angle between vertical and horizontal with respect to the vacuum chamber 12. The rectangular shape of the seal 18 may be appropriate where an entire forward end of a rectangular shaped microchip 20*c* is held in the vacuum chamber 12. The seal 18 can be on the microchip 20 and/or on the wall 12*w* of the chamber 12*w* and/or housing 10*h* or in a vacuum fitting that is sized and configured to matably, sealably receive an end portion of the microship 20*c*.

As shown in FIG. 4D, the vacuum chamber wall 12*w* can define an electric barrier for the external portion of the microchip 20*c*, and can be at ground potential 127. Electrical and/or pressurized gas connections for ESI for causing transport of a sample through a processing channel and/or the electrospraying into vacuum chamber 12 can be made through and/or at the chip reservoirs 20*r* to pressurized gas supply or supplies 120*p* and/or a power supply or supplies 120.

For metal ESI capillaries 20*t*, a spray voltage can be applied to the capillary body. With glass, quartz, and/or insulating capillaries, a gold or other suitable conductive, typical metal, coating can be applied to the spray tip with the conductive coating exiting through the seal 18 into the environment external of the vacuum chamber 12. In some embodiments, the analysis system 100 can include a liquid junction that resides outside the vacuum chamber 12 where the ESI voltage can be applied.

In some embodiments, the ESI device 20 shown as a microfluidic chip 20*c* in FIGS. 1, 2, 3A, 4A, and 4D for example, can be instead a capillary tube 20*t* with the emitter 20*e* which resides outside of the vacuum chamber 12 and cooperates with the inlet device 15.

Conventional mass spectrometry systems typically operate at mass analyzer pressures of about $10^{-6}$ Torr, which is several orders of magnitudes smaller than the operating pressures of the embodiments of the invention. To the extent that spraying into vacuum chambers close to atmospheric pressure (e.g., about 600 Torr) has been contemplated, these vacuum chambers were separate from the mass analyzer and employed an inlet capillary into a commercial mass spectrometer which leads to ion loss. See, e.g., Felton et al., Automated High-Throughput Infusion ESI-MS with Direct Coupling to a Microtiter Plate, Anal Chem. 2001, 73, pages 1449-1454; and Zhang et al., High-Throughput Microfabricated CE/ESI-MS: Automated Sampling from a Microwell Plate, Anal Cham. 2001, 73, 2675-2681, the contents of which are incorporated by reference as if recited in full herein. In contrast, and advantageously, the new direct spray of ions into a high pressure vacuum chamber 12 holding the mass an analyzer 30 can avoid such ion losses, e.g., there is significantly reduced or no ion loss going through the (single) atmospheric to high pressure interface to the vacuum chamber with the mass analyzer relative to a differential pressure interface.

As shown in FIGS. 3B, 3C, 4B, 4C and 4D, the emitter 20*e* of the fluidic processing device 20 that discharges a sample with ions can be closely spaced apart from the mass analyzer 30. The axial distance from the emitter 20*e* to the entry of the mass analyzer 30 (e.g., first endcap electrode 31 of an ion trap where an ion trap is the mass analyzer 30), shown in FIGS. 3B, 3C, 4B, 4C, and 4D as Di-m, can be between about 1 mm and about 50 mm, about 1 mm and about 40 mm, about 1 mm and about 30 mm, between 1 mm and 20 mm, or between 1 mm and 10 mm. In some embodiments, the spacing can maximize ion transmission without requiring complex ion optics. In some embodiments, the at least one emitter 20*e* can reside between about 1 mm to about and 20 mm or between about 1 to about 10 mm from an entrance aperture of the mass analyzer, e.g., first endcap electrode 31. In particular embodiments, the Di-m distance can be about 1 mm, about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, and about 20 mm, from an ion entry aperture/electrode of the mass analyzer 30.

In the embodiments shown in FIGS. 1, 2, 3A-3C, 4A-4D, the mass analyzer 30 comprises at least one ion trap 30 with an array of closely spaced apart electrodes (conductors). The electrodes comprise a center (ring) electrode 33 residing between two endcap electrodes 31, 32. The electrodes can have axially aligned apertures with a distance "b" between centers of adjacent apertures. The apertures can be arranged in a regular pattern or may be random. The ring electrode 33 can have one or more apertures 33*a* that will generally be larger than the first or second endcap electrode apertures. The term "ring electrode" refers to the center electrode in the ion trap array that is between the end cap or end electrodes 31, 32 and is not required to have a ring shape form factor, e.g., either in an outer perimeter or in a bounding channel of a respective ion trap. As is well known, a respective ion trap 30 can have short tubular channels of different diameters of aligned end cap and ring apertures. One or both of the endcap electrodes 31, 32 can comprise or be in the form of a mesh electrode and/or conductive screen.

Figure 5A:
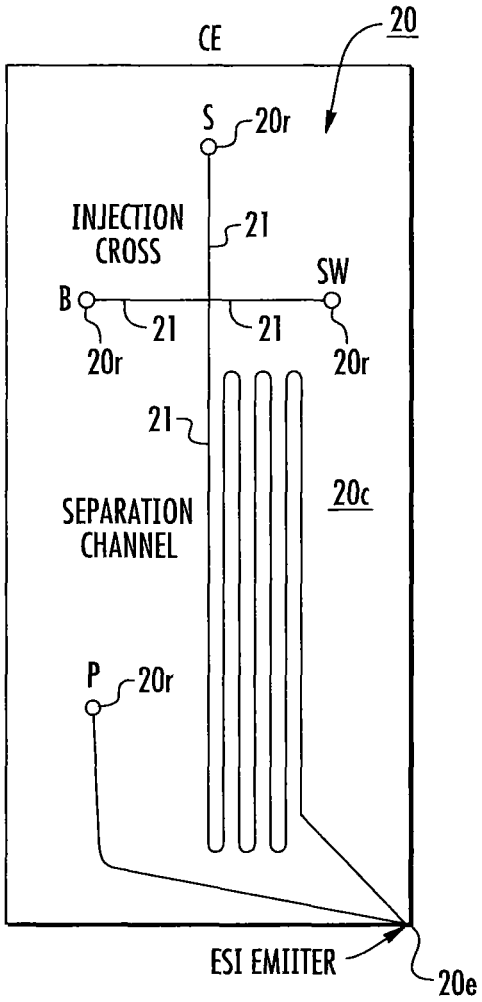
FIGS. 5A and 5B are enlarged schematic illustrations of exemplary electrospray devices according to embodiments of the present invention.
Figure 5B:
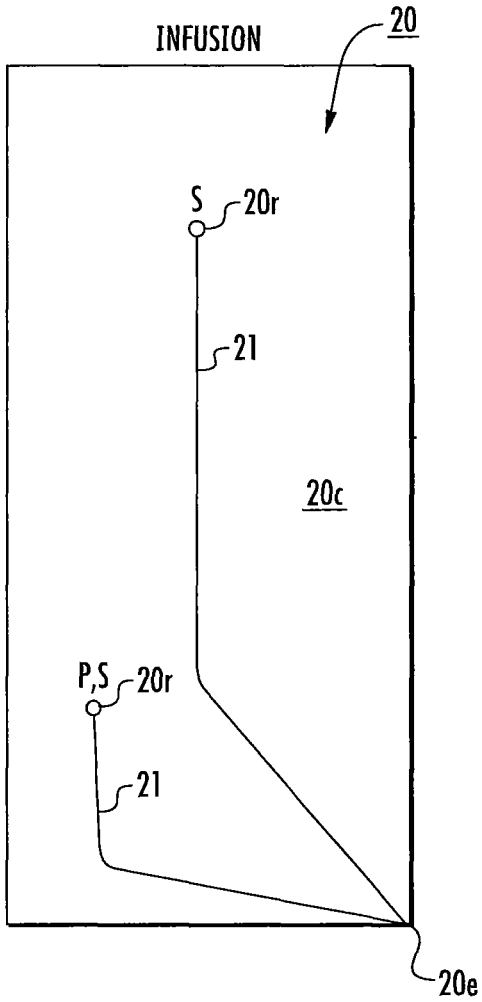

As shown in FIGS. 5A and 5B, for example, the ESI device 20 can be a microfluidic chip 20*c* which includes reservoirs 20*r* and fluidic microchannels and/or nanochannels 21 for samples (S), sample waste (SW), buffer (B) and/or (electro-osmotic) pumping (P). See, e.g., co-pending PCT/US2012/027662 and PCT/US2011/052127 for a description of examples of microfabricated fluidic devices. See, also, Mellors, J. S.; Gorbounov, V.; Ramsey, R. S.; Ramsey, J. M., Fully integrated glass microfluidic device for performing high-efficiency capillary electrophoresis and electrospray ionization mass spectrometry. *Anal Chem* 2008, 80 (18), 6881-6887. For additional information that may be useful for some designs, see also, Xue Q, Foret F, Dunayevskiy Y M, Zavracky P M, McGruer N E & Karger B L (1997), Multichannel Microchip Electrospray Mass Spectrometry. *Anal Chem* 69, 426-430, Ramsey R S & Ramsey J M (1997), Generating Electrospray from Microchip Devices Using Electroosmotic Pumping. *Anal Chem* 69, 1174-1178, Chambers A G, Mellors J S, Henley W H & Ramsey J M (2011), Monolithic Integration of Two-Dimensional Liquid Chromatography—Capillary Electrophoresis and Electrospray Ionization on a Microfluidic Device. *Analytical Chemistry* 83, 842-849. Mellors et al., Anal Chem. 2008, 80 (18), 6881-6887; Batz et al., Anal. Chem., 2014, 86 (7) 3493-5000; and U.S. Pat. No. 9,006,648. The contents of these documents are hereby incorporated by reference as if recited in full herein.

Figure 6A:
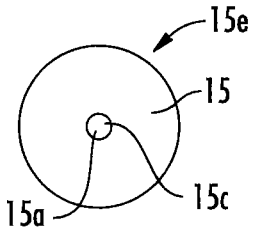
FIG. 6A is an end view of an exemplary inlet device according to embodiments of the present invention.
Figure 6C:
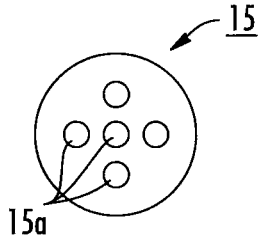
FIG. 6C is an end view of an alternative configuration of the inlet device shown in FIG. 6A according to embodiments of the present invention.
Figure 6B:
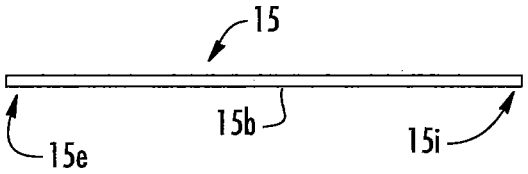
FIG. 6B is a side view of the device shown in FIG. 6A.

FIGS. 6A and 6B illustrate one example of an inlet device 15. As shown, the inlet device 15 can have an elongate tubular body 15*b* extending between the internal end 15*i* and the external end 15*e*. The device 15 can have at least one (shown as a single) inlet aperture 15*a* which merges into a longitudinally extending fluid ("fluid" refers to liquid and/or gas") channel 15*c*. The device 15 can be sized and configured to have at least one capillary channel, e.g., be configured as a capillary tube. The at least one channel 15*c* can have a width and/or height dimension (shown as circular with a diameter) that is between about 0.05 mm to about 0.50 mm, more typically between about 0.100 mm to about 0.250 mm, and, in some embodiment can be about 0.125 mm. Other cross-sectional channel shapes may be used instead of circles.

FIG. 6C illustrates the at least one inlet aperture 15*a* can be a plurality of inlet apertures 15*a* each merging into a respective inlet channel 15*c*. Alternatively, two or more inlets 15*a* may merge into a shared elongate channel 15*c*. Although shown as five apertures 15*a*, more or fewer apertures 15*a* may be used, e.g., 2, 3, 4, 6, 7, 8, 9 or 10, for example.

The inlet device 15 can, in some embodiments, have an outer diameter that is between 1-5 mm, such as about 1 mm, about 1.2 about 1.5 mm, about 1.6 mm, about 1.7 mm, about 1.8 mm, about 1.9 mm and about 2 mm.

The inlet device 15 can have a length between 1 cm and 20 cm, typically between 5 and 15 cm such as about 5 cm, about 6 cm, about 7 cm, about 8 cm, about 9 cm, about 10 cm, about 11 cm, about 12 cm, about 13 cm, about 14 cm and about 15 cm, in some embodiments.

FIGS. 7A-7D illustrate that the external end 15*e* can have a conical-shape or a cone skimmer device 15*c* with at least one inlet aperture 15*a* centered about the cone tip. In some embodiments, the conical shape can be frustoconical with a flat forwardmost end holding the aperture 15*a* that tapers back to the body of the inlet device 15 to form the cone shaped tip. The external end 15*e* can be monolithic to the body 15*b* of the inlet device or can be a separate component attached to the primary body 15*b* of the inlet device 15. The at least one aperture 15*a* can have a width and/or height dimension (shown as circular with a diameter) that is between about 0.025 mm to about 0.50 mm, more typically between about 0.030 mm to about 0.125 mm, and, in some embodiments, can be about 0.100 mm, about 0.110 mm or about 0.125 mm. Other cross-sectional channel shapes may be used instead of circles.

Figure 7A:
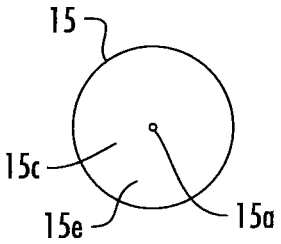
FIG. 7A is an end view of another embodiment of an end portion of an exemplary inlet device according to embodiments of the present invention.
Figure 7B:
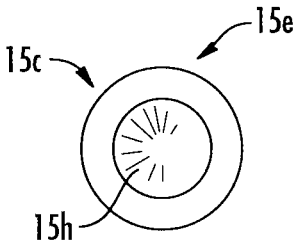
FIG. 7B is an opposing end view of the device shown in FIG. 7A.
Figure 7C:
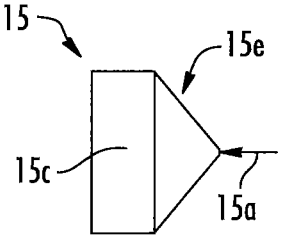
FIG. 7C is a side view of the device shown in FIG. 7B.

The conical head 15*e* can be a solid body that has the at least one aperture and at least one axially extending fluid channel. In other embodiments, as shown in FIG. 7B, the conical head 15*e* can be a shaped body of a thin malleable or molded material with a hollow interior 15*h* that is much larger than the aperture 15*a* and that can attach to the tubular longitudinally extending body 15*b*.

Figure 7E:
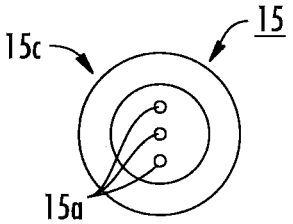
FIG. 7E is an end view of an alternative configuration of the inlet device shown in FIG. 7A according to embodiments of the present invention.
Figure 7D:
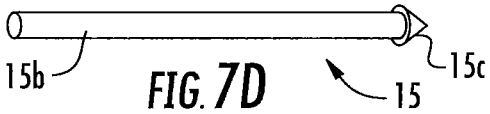
FIG. 7D is a side view of an inlet tube with a conical end as shown in FIG. 7A or 7E, for example, according to embodiments of the present invention.

FIG. 7E illustrates that the inlet device 15 can have a plurality of inlet apertures 15*a*. Although shown as three apertures 15*a*, more or fewer apertures 15*a* may be used, e.g., 2, 4, 5, 6, 7, 8, 9 or 10, for example. The plurality of inlet apertures 15*a* can each merge into a respective one of a plurality of inlet channels 15*c*. Alternatively, two or more inlet apertures 15*a* may merge into a shared elongate channel 15*c*.

FIGS. 8A-8D illustrate another embodiment of the inlet device 15. In this embodiment, the axial extent of the channel 15*c* is similar to the diameter of the aperture 15*a*. The inlet device 15 can have a planar body 15*p* (e.g., a relatively thin plate). The planar body 15*p* can have a thickness of between about 0.100 mm to about 5 mm, more typically between about 0.100 mm to about 0.50 mm. In some embodiments, the thickness can be between about 0.125 mm and about 0.30 mm, such as about 0.125 mm, about 0.150 mm, 0.200 mm, about 0.250 mm, and about 0.30 mm. The aperture 15*a* can have a diameter that is between about 0.01 mm and 0.150 mm, for example. In some embodiments, the axial extent or length of the channel 15*c* through the body of the plate 15*p* is about the same or no more than about 50% greater in size relative to the diameter (or maximum cross-sectional dimension for non-circular shapes) of the inlet aperture 12*a* (where one aperture is used) or one of the inlet apertures 12*a* (where more than one are used).

Figure 8A:
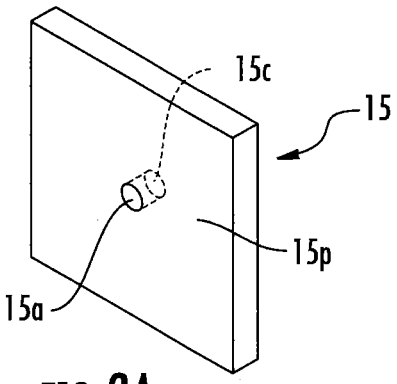
FIG. 8A is a side perspective view of another exemplary inlet device according to embodiments of the present invention.
Figure 8B:
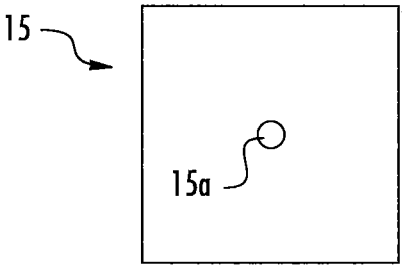
FIG. 8B is an end view of the device shown in FIG. 8A.
Figure 8C:
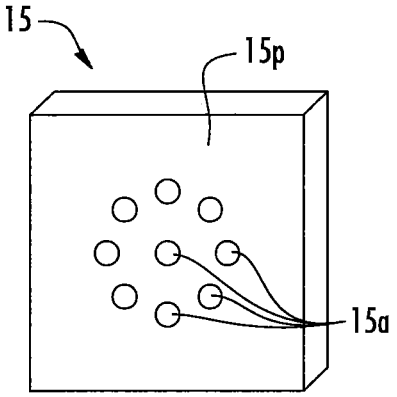
FIG. 8C is a side perspective view of a multiple aperture inlet device, similar to the device shown in FIG. 8A, according to embodiments of the present invention.
Figure 8D:
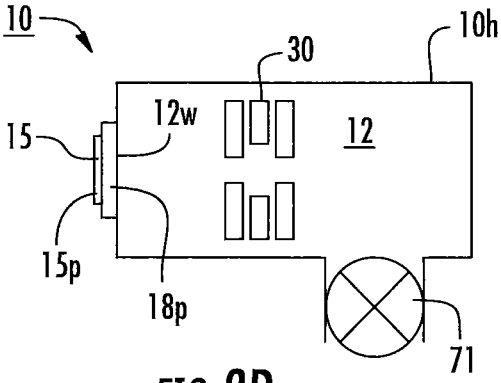
FIG. 8D is a schematic illustration of a HPMS device with a vacuum chamber and the inlet device shown in FIG. 8A or 8C, for example, according to embodiments of the present invention.

FIG. 8D shows that the inlet device 15 can be sealably attached to the mass spectrometer 10. In other embodiments, the inlet device can be monolithic with the wall of the housing 10*h* of the mass spectrometer 10 and/or wall 12*h* of the vacuum chamber 12 holding the mass analyzer 30. In some embodiments, a plate and an o-ring seal 18*p* can be used to attach the inlet device 15 to the mass spectrometer 10. The inlet device 15 can nest in a vacuum fitting that screws into the wall 12*h* with a small aperture(s) 15*a* for ions. The inlet device 15 can also be implemented as a vacuum fitting that screws directly into the wall 12*w* with a small aperture(s) 15*a* for ions. The Di-m distance measured from the external emitter 20*e* to the ion entry of the mass analyzer 30 in the vacuum chamber 12 may be between 1-10 cm, such as about 1 cm, about 2 cm, about 3 cm, about 4 cm, about 5 cm, about 6 cm, about 7 cm, about 8 cm, about 9 cm and about 10 cm. In some embodiments, the distance Di-m is between 10 mm and about 150 mm.

Figure 9A:
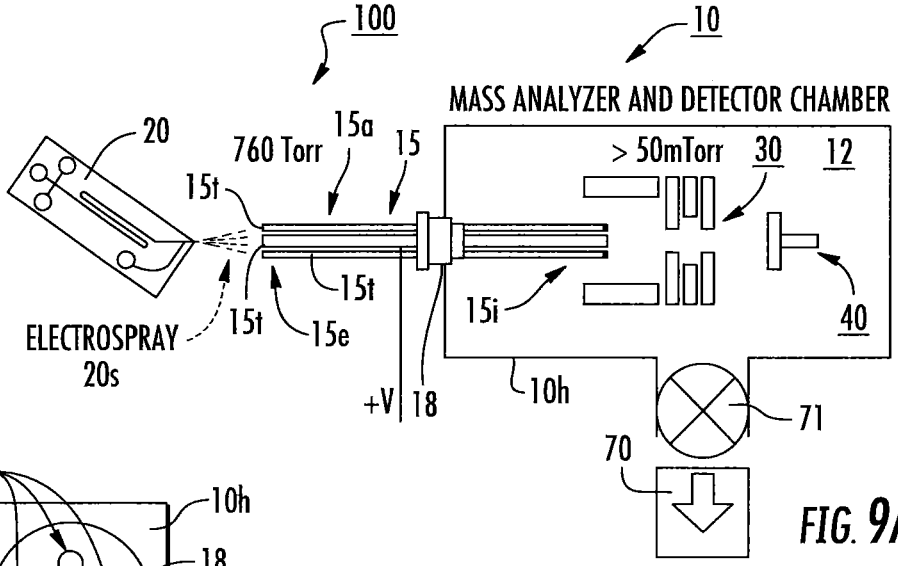
FIG. 9A is a schematic illustration of another exemplary analysis system with a mass spectrometer with an electrospray ionization (ESI) interface according to embodiments of the present invention.
Figure 9B:
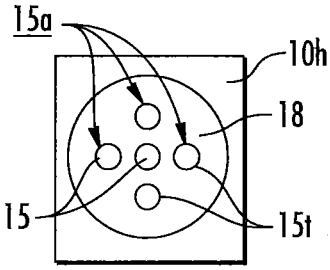
FIG. 9B is an end view of the ESI interface according to embodiments of the present invention.

FIGS. 9A and 9B illustrate that the analysis system 100 can have a multiple tube arrangement, each tube 15*t* providing at least one inlet aperture 15*a* at ambient (e.g., atmospheric) pressure during operation to intake electrospray 20*s*. The tubes 15*t* can be held as an assembly that each extend into the mass analyzer chamber 12 of the mass spectrometer housing 10*h* via at least one vacuum seal connector and/or fitting 18. Although shown as five closely spaced apart tubes 15*t* in FIG. 9B, fewer or more than five may be used, e.g., 2, 3, 4 or 6, for example. The tubes 15*t* can have the same or different lengths and reside a common or staggered internal or external location.

Where the inlet device 15 includes a plurality of inlet apertures 15*a*, FIGS. 6C, 7D, 8C, 9A, 9B, for example, each can have the same size or a different size inlet aperture 15*a* and/or channel width/height (e.g., diameter where circular shaped apertures are used). Thus, a respective aperture 15*a* can have a width and/or height dimension (shown as circular with a diameter) that is between about 0.05 mm to about 0.50 mm, more typically between about 0.100 mm to about 0.250 mm, and, in some embodiments can be about 0.100 mm, about 0.110 mm or about 0.125 mm. Again, other cross-sectional channel shapes may be used instead of circles. Some apertures 15*a* may be larger than others. The apertures 15*a* can be regularly or irregularly spaced apart.

In some embodiments, calculated electrospray inlet gas flow rates through the inlet device 15 can be between about 1 sccm and 115 sccm, but may be greater or smaller in some embodiments.

Liquid flow rates from the ESI devices 20 are typically between 50 and 300 nL/min, in some particular embodiments. In some embodiments, ESI flow rates, e.g., typically <1 μL/min, may be used. Larger ESI emitters such as glass, quartz or metal capillaries with internal diameters greater than 100 μm can have liquid flow rates >1 μL/min.

Embodiments of the invention are directed to compact or miniaturized configurations of ion trap mass analyzers used in a device that determines ion mass to charge ratio and can additionally provide relative abundance information for a number of ions ranging across mass to charge values. The specific examples described herein are particularly relevant to ion trap mass analyzers such as the Paul trap, cylindrical ion trap (CIT), Stretched Length Ion Trap (SLIT), and the rectilinear ion trap, for example.

In the embodiment shown in FIGS. 1-4, the mass analyzer 30 comprises a at least one ion trap, e.g., in a respective array, such as between about 1-800, typically between about 5-256, more typically between about 5-50, including 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49 and 50, for example. In some embodiments, the ion trap 30 can have a stretched length ion trap (SLIT) configuration with a single trap or with multiple such traps. For the latter, where used, the number of traps can be between 2-50. See, e.g., U.S. Pat. No. 8,878,127, to Ramsey et al., entitled "Miniature Charged Particle Trap With Elongated Trapping Region For Mass Spectrometry, the contents of which are hereby incorporated by reference as if recited in full herein. However, other ion trap aperture shapes and aperture array configurations may be used.

The pump(s) 70 can be any suitable pump, typically small, light weight pumps. Examples of pumps include, for example only, a TPS Bench (SH110 and Turbo-V 81 M pumps) compact pumping system and/or a TPS compact (IDP-3 and TurboV 81M pumps) pumping system from Agilent Technologies, Santa Clara, Calif. Operational pressures at or above 50 mTorr can be easily achieved by mechanical displacement pumps such as rotary vane pumps, reciprocating piston pumps, or scroll pumps.

Figure 10A:
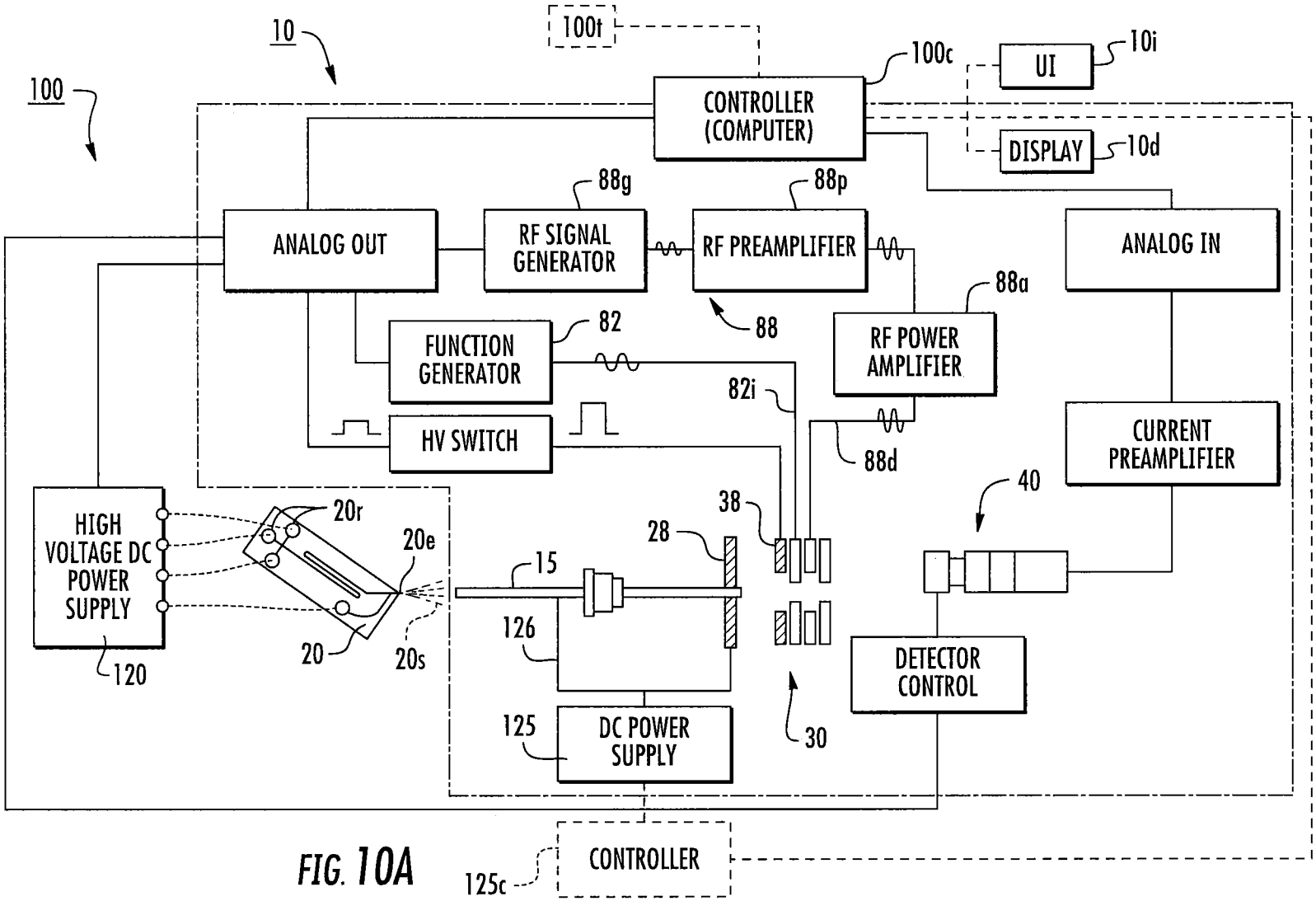
FIG. 10A is a block diagram of an analysis system comprising an ESI device and mass spectrometry system according to embodiments of the present invention.
Figure 10B:
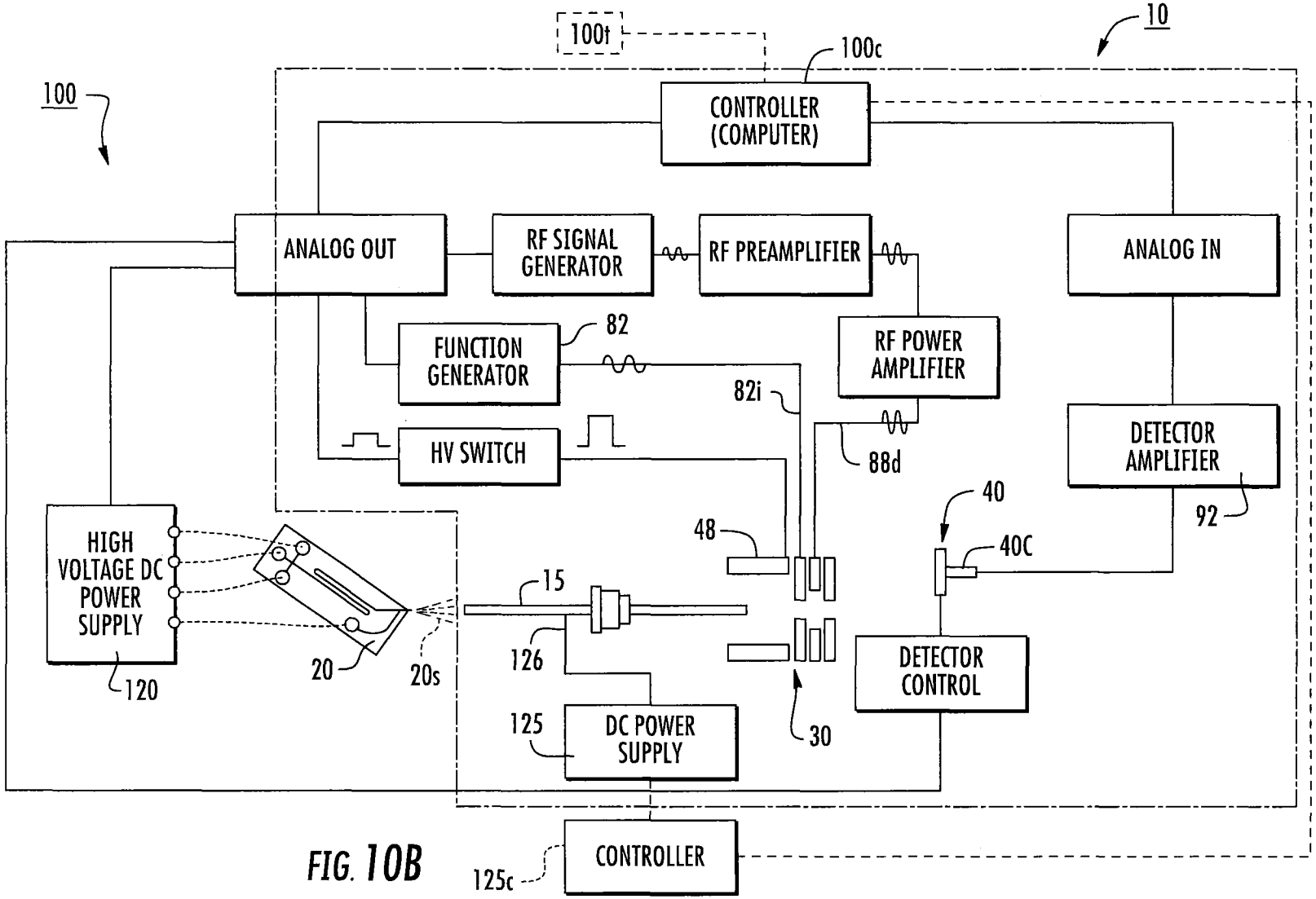
FIG. 10B is another block diagram of an analysis system comprising an ESI device and mass spectrometry system according to embodiments of the present invention.

FIGS. 4A-4D, 9A and 10B illustrate that the detector 40 can comprise a Faraday cup detector 40C in communication with an amplifier such as a differential amplifier (908 Devices, Boston, Mass.). The ions signal can be collected on a Faraday cup detector 40C and amplified by an amplifier 92 (FIG. 10B). One example of an amplifier 92 is aA250CF CoolFET® Charge Sensitive Preamplifier from Amptek Inc. Other detector configurations and other amplifiers may be used.

Ions can be accumulated for a defined time for a respective scan, such as between about 1-30 milliseconds, typically between about 1-10 milliseconds, before analysis, in some embodiments. Successive scans can be averaged for each analysis, typically between 20-1000 individual scans.

In some embodiments, the volume of the mass analyzer compartment/chamber 12 with only the mass analyzer 30 (in a dual vacuum chamber configuration) or with both the mass analyzer 30 and the detector 40 in a single vacuum chamber arrangement, can be relatively small, such as between about 0.25 $in^3$ to about 16 $in^3$, typically between about 1 $in^3$ to about 10 $in^3$, such as about 1 $in^3$, about 2 $in^3$, about 3 $in^3$, about 4 $in^3$, about 5 $in^3$, about 6 $in^3$, about 7 $in^3$, about 8 $in^3$, about 9 $in^3$, about 10 $in^3$.

As shown in FIG. 4A for example, the chamber 12 can reside in a compact housing **20*h*** having a length L and height (or width) dimension H. The length dimension L can be between about 1-5 inches, typically between about 1-3 inches, such as about 1 inch, about 1.5 inches, about 1.75 inches and about 1.85 inches, for example. The height/width dimension H can be between about 0.5 inches to about 5 inches, typically about 1 inch. The depth or "z" dimension can be between 1-5 inches, typically about 1-3 inches.

In some embodiments, the forward end of the ion trap 30 is closely spaced "Dd" to the detector 40, which may be particularly advantageous for small mass spectrometry systems operating at high pressure due to the reduced mean free paths experienced by the ejected ions at such pressures. In some embodiments, the spacing Dd (FIGS. 1, 2, 3A-3C, 4A-4C) is between about 0.01 inches (0.254 mm) to about 0.5 inches (13 mm), more typically between about 1 mm and about 10 mm.

Referring again to FIGS. 1, 2, 3A-3C and 4A-4C, where the mass analyzer 30 comprises an ion trap, the ring electrode apertures will generally be larger than the first or second end cap electrode apertures and/or may be mesh style endcaps. When one or more of the endcap electrodes 31, 32 are implemented as mesh style endcaps, the electrodes can include an aperture covered by a fine grid metal mesh, typically between 100-1000 wires per inch.

As is well known, a respective ion trap has a tubular channel of different diameters of aligned end cap and ring apertures. The end cap electrodes 31, 32 are spaced a distance d away from the ring electrode 33, typically in symmetric spacing. The specific spacing depends on the ring electrode thickness, but a distance spacing of the end cap electrodes 31, 32 can be chosen to optimize mass spectrometry performance. The end cap apertures or holes allow the injection of ionization energy or ions and the other endcap apertures allow for the ejection of ions for detection purposes.

The electrode apertures 31, 32, 33 each have a radius $r_0$ or average effective radius (e.g., the latter calculates an average hole size using shape and width/height dimensions where non-circular aperture shapes are used) and the trap 30 has a corresponding diameter or average cross distance $2r_0$ and an effective length $2z_0$. The ion trap 30 can be configured to have a defined ratio of $z_0/r_0$ that is greater than 0.83. Note that $z_0$ can be defined as the half-height of the cavity. In some embodiments, the ion trap aperture array has an effective length $2z_0$ measured as the distance between interior surfaces of the end caps 31, 32. The array can be configured to have a defined ratio of $z_0/r_0$ that is near unity but is generally greater than unity by about 10% to about 30%. The $r_0$ and $z_0$ dimensions can be between about 0.5 μm to about 1 cm, but for microscale mass spectrometry applications contemplated by certain embodiments of the invention, these dimensions are preferably 1 mm or less, down to about 0.5 μm. The mass analyzer 30 can be an ion trap with three stacked (metal) electrodes 31, 32, 33 separated by insulators. For further discussion of exemplary CIT configurations, see U.S. Pat. Nos. 6,933,498, and 6,469,298, the contents of which are hereby incorporated by reference as if recited in full herein. An example of a single electrode ionizer is described in Kornienko, Anal. Chem. 2000, 72, 559-562 and Kornienko, *Rapid Commun. Mass Spectrom.* 1999, 13, 50-53, the contents of which are hereby incorporated by reference as if recited in full herein.

The distance "d" is typically chosen such that $z_0$ is slightly larger than $r_0$, typically 10-30% larger.

In some embodiments, the mass spectrometer system 100 can be configured with one or more mass analyzers 30. Where ion traps are the mass analyzers 30, the ion traps can comprise more than one trapping cavity. In some embodiments, mass ejection from each of the cavities may be detected by a single detector 40 to produce a composite (combined enhanced) mass spectrometry signal. In some embodiments, the signal for detection may be based on outputs from a subset of different traps. In some embodiments, mass ejection from each or a subset or groups of cavities may be detected by separate detectors. This arrangement may be useful in cases where each cavity or groups (subsets) of cavities have different trapping properties. For example, an arrangement of this type may extend the range of ion masses that can be analyzed by the spectrometer system.

In some embodiments, a compact (small footprint) mass spectrometer 10 that can be configured to have a plurality of the dual chamber devices or a plurality of the single chamber devices so as to concurrently sample multiple samples using a common or different detector or detectors 40.

In some embodiments, the mass analyzer 30 (such as, but not limited to, an ion trap mass analyzer), and the detector 40 can all be arranged as a releasably attached set or integrally attached unit of stacked planar conductor and insulator components, e.g., typically alternating conductive and insulating films, substrates, sheets, plates and/or layers or combinations thereof, with defined features for the desired function. See, e.g., co-pending, co-assigned U.S. patent application Ser. No. 13/804,911, the contents of which are hereby incorporated by reference as if recited in full herein.

The detector 40 can include an appropriate transducer. The transducer typically comprises an electron multiplier (FIGS. 1, 3A-3C, and 9A) but may be a planar detector and, in particular embodiments, as shown in FIG. 4A-4C, and 10B, the detector 40 comprises a Faraday cup detector 40C. However, other ion detectors may be used.

In some embodiments, the detector 40 can comprise a planar detector for charge detection which may be particularly attractive for small mass spectrometry systems due to their inherently small size and weight and the ability to operate at pressures from low vacuum to atmospheric pressure. Charges collected by a conductive film or other conductor associated with the detector 40 can be measured either with an electrometer or a charge sensitive transimpedance amplifier. The term "electronic collector" refers to an electronic circuit and/or device that can detect charges collected by the film and/or conductor.

For example, the detector 40 can be configured to detect ions ejected in parallel from a planar CIT array with a planar electrode with a solid continuous conductive surface over the holes of the end cap electrode. The gain of a detector amplifier 92 (FIG. 9) such as, for example, a charge sensitive transimpedance amplifier, may be improved with reduced Faraday cup capacitance.

The mass spectrometer system 10 can be lightweight, typically between about 1-25 pounds (including a vacuum pump or pumps), and, optionally, batteries. The housing 10*h* holding the mass spectrometer system and ESI inlet device 15 can be configured as a handheld or benchtop housing. In some embodiments, a portable housing can have a form factor similar in size and weight as a Microsoft® Xbox®, Sony® PLAYSTATION® or Nintendo® Wii® game console or game controller, or similar to a form factor associated with an electronic notebook, PDA, IPAD or smartphone and may optionally have a pistol grip. However, other configurations of the housing may be used as well as other arrangements of the control circuit. The housing 10*h* typically holds a display screen 10*d* and can have a User Interface 10*i* such as a Graphic User Interface ("GUI") (FIG. 10A).

The system 100 may also include a transceiver, GPS module and antenna and can be configured to communicate with a smartphone or other pervasive computing device (laptop, electronic notebook, PDA, IPAD, and the like) to transfer data or for control of operation, e.g., with a secure APP or other wireless programmable communication protocol.

In some embodiments, the mass spectrometer 100 is configured so that the ESI device 20 as the ion source transmits ions at atmospheric pressure to the inlet device 15 and the mass analyzer 30 and detector 40 operate at near isobaric conditions and at a pressure that is greater than 100 mTorr.

As shown in FIGS. 10A and 10B, the analysis system 100 can include a spectrometer 10 with a function generator 82 to provide a low voltage axial RF input 82*i* to the mass analyzer (e.g., ion trap) 30 during mass scan for resonance ejection. The low voltage axial RF can be between about 100 mVpp to about 12,000 mVpp, typically between 100 to 10,000 mVpp. The axial RF can be applied to an end cap 31 or 32, typically end cap 31, or between the two end caps 31 and 32 during a mass scan for facilitating resonance ejection. An RF power source 88 provides an input signal to the ring electrode 33. The RF source 88 can include an RF signal generator 88*g*, RF amplifier 88*p*, and RF power amplifier 88*a*. The controller 100*c* can have a control circuit with an optional RF monitor. Some or all of these components can be held on a circuit board in the housing 10*h* enclosing the mass analyzer 30 in the chamber 12. In some embodiments, an amplitude ramp waveform can be provided as an input to the RF signal generator to modulate the RF amplitude. The low voltage RF can be amplified by a RF preamplifier then a power amplifier to produce a desired RF signal. The RF signal can be between about 1 MHz to 10 GHz or 1 MHz to 1000 MHz, depending on the size of the ring electrode features. As is well known to those of skill in the art, the RF frequency depends reciprocally on the ring electrode radius, $r_0$. A typical RF frequency for an $r_0$ of 500 μm would be 5-20 MHz. The voltages can be between 50 $V_{0p}$ to about 1500 $V_{0p}$, typically up to about 500 $V_{0p}$ (as is well known to those of skill the "0p" subscript refers to zero-to-half peak).

As also shown, the system 100 includes a voltage DC power supply 120 for the ESI device 20 and a direct current (DC) power supply 125 for the inlet device 15 alone (FIG. 10B) or for both the inlet device 15 and an electrode in the chamber 12 (FIG. 10A). The DC power supply 120 can optionally be controlled by a common controller 100*c* or a separate controller or even manually. The ESI power supply 120 can be a high voltage power supply. The term "high voltage" refers to voltage in the kV range, typically between about 1-10 kV, more typically between about 2-5 kV. ESI devices 20 can be configured to employ potentials of a few kVs, typically between about 1 kV to about 5 kV, for example.

The ion detector 40 can be configured to register the number of ions emitted at different time intervals that correspond to particular ion masses to perform mass spectrometric chemical analysis. The ion trap dynamically traps ions from a measurement sample using a dynamic electric field generated by an RF drive signal. The ions are selectively ejected corresponding to their mass-to-charge ratio (mass (m)/charge (z)) by changing the characteristics (e.g., amplitude, frequency, etc.) of the trapping radio frequency (RF) electric field. Relative ion abundances at particular m/z ratios can be digitized for analysis and can be displayed as spectra on an onboard and/or remote processor.

In the simplest form, a drive RF signal 88*d* of constant RF frequency can be applied to the center electrode 33 relative to the two end cap electrodes 31, 32. The amplitude of the center electrode signal can be ramped up linearly in order to selectively destabilize different m/z of ions held within the ion trap. This amplitude ejection configuration may not result in optimal performance or resolution. However, this amplitude ejection method may be improved upon by applying a second signal differentially across the end caps 31, 32. This axial RF signal, where used, causes a dipole axial excitation that can result in the resonant ejection of ions from the ion trap when the ions' secular frequency of oscillation within the trap matches the end cap excitation frequency.

The ion trap 30 or mass filter can have an equivalent circuit that appears as a nearly pure capacitance. The amplitude of the voltage to drive the ion trap 30 may be high (e.g., 100 V-1500 Volts) and can employ a transformer coupling to generate the high voltage. The inductance of the transformer secondary and the capacitance of the ion trap can form a parallel tank circuit. Driving this circuit at resonant frequency may be desired to avoid unnecessary losses and/or an increase in circuit size.

The buffer gas can be provided as a pressurized canister of buffer gas as the source (160, FIG. 2, for example). However, any suitable buffer gas or buffer gas mixture including air, helium, hydrogen, or other gas can be used. Where air is used, it can be pulled from atmosphere and no pressurized canister or other source is required.

Figure 11A:
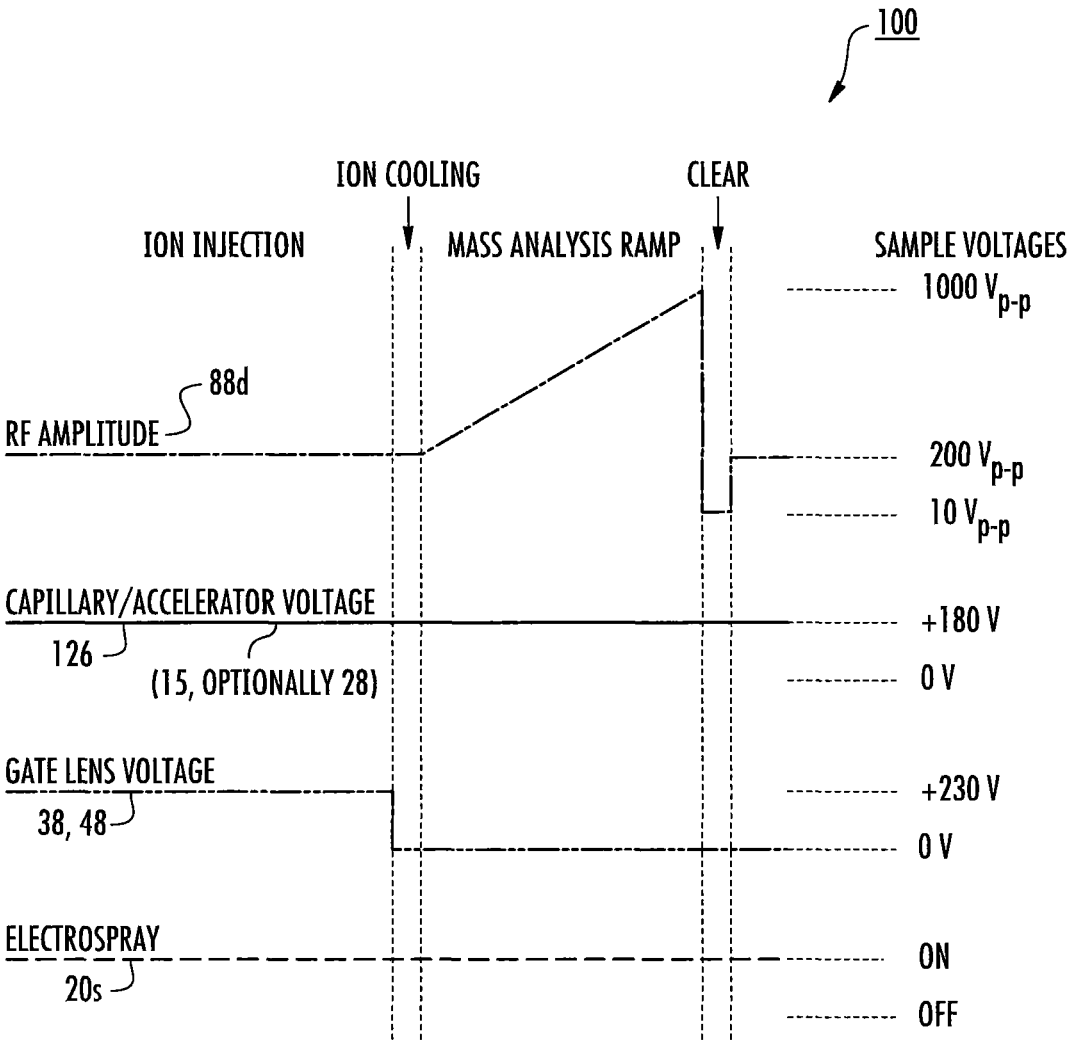
FIGS. 11A-11C are exemplary timing diagrams of an analysis system according to some embodiments of the present invention.
Figure 11B:
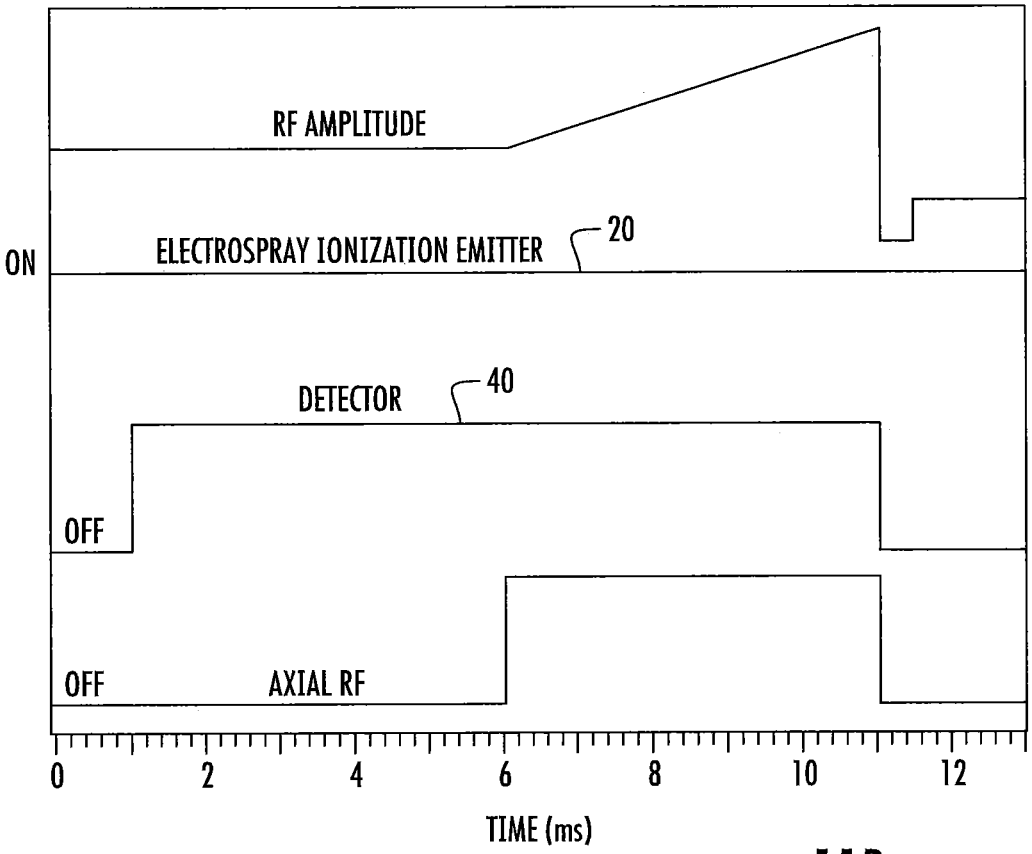
Figure 11C:
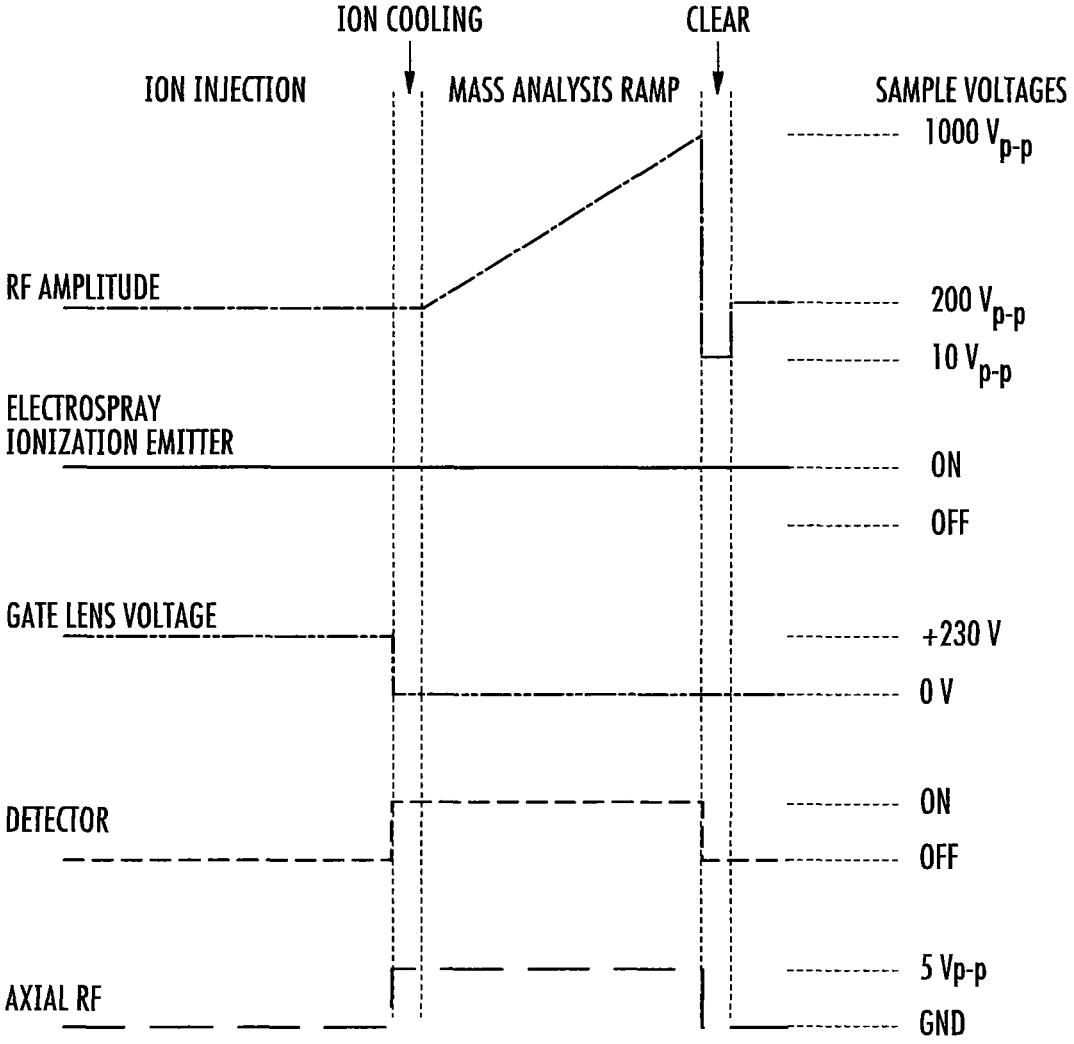

FIGS. 11A and 11C illustrate an exemplary timing diagram that can be used to carry out/control various components of the analyzer system 10 with the mass spectrometer 100. During ion injection, a focusing electrode, e.g., the lens 38 or 48 (if used) is ON to focus the ions to the mass analyzer 30. The drive RF amplitude can then be held constant for a defined time, e.g., about 5 ms, to allow trapped ions to collisionally cool towards the center of the trap. The drive RF amplitude can be linearly ramped to perform a mass instability scan and eject ions toward the detector 40 in order of increasing m/z. Data is acquired during the mass instability scan to produce a mass spectrum and the convective transport can enhance the signal for detection. Finally, the drive RF amplitude 88*d* can be reduced to a low voltage to clear any remaining ions from the trap 30 and prepare it for the next scan. A number of ion manipulation strategies can be applied to ion trap devices such as CITs, as is well known to those trained in the art. Different strategies to eject, isolate, or collisionally dissociate ions can be applied to the ion trapping structures.

Optionally, as shown in FIGS. 11B and/or 11C, an axial RF signal can be synched to be applied with the start of the RF amplitude signal linear ramp so as to be substantially simultaneously gated on to perform resonance ejection during the mass scan for improved resolution and mass range The flowcharts and block diagrams of certain of the figures herein illustrate the architecture, functionality, and operation of possible implementations of mass spectrometers or assemblies thereof and/or programs according to the present invention. In this regard, each block in the flow charts or block diagrams represents a module, segment, operation, or portion of code, which comprises one or more executable instructions for implementing the specified logical function(s). It should also be noted that in some alternative implementations, the functions noted in the blocks might occur out of the order noted in the figures. For example, two blocks shown in succession may in fact be executed substantially concurrently or the blocks may sometimes be executed in the reverse order, depending upon the functionality involved.

As shown in FIGS. 10A and 10B, the mass spectrometer 10 can include a transmitter or transceiver 100*t* that allows it to wirelessly communicate with a local and/or remote processor and/or server using, for example, a LAN (local area network), WAN (wide area network), an intranet and/or the Internet. The mass spectrometer 10 can be configured to generate an audible and/or visual alert if an environmental, industrial or other hazard is detected. The controller 100*c* can also or alternatively generate a local or remote alert when buffer gas is detected as being low or based on an assumed use rate/volume of the consumable input. The alert(s) may also be sent automatically via the Internet, WAN, LAN or the intranet to one or more local or remote sites for notification of a potential danger, for example. The alert can be sent to a cellular telephone, landline telephone, electronic notebook, electronic note pad or tablet, portable computer or other pervasive computing device.

The mass spectrometer 10 can include or communicate with an analysis module and/or circuit that can identify a substance by the obtained mass spectra. The analysis module or circuit can be onboard or at least partially remote from the spectrometer device 10. If the latter, the analysis module or circuit can reside totally or partially on a server. The server can be provided using cloud computing which includes the provision of computational resources on demand via a computer network. The resources can be embodied as various infrastructure services (e.g. computer, storage, etc.) as well as applications, databases, file services, email, etc. In the traditional model of computing, both data and software are typically fully contained on the user's computer; in cloud computing, the user's computer may contain little software or data (perhaps an operating system and/or web browser), and may serve as little more than a display terminal for processes occurring on a network of external computers. A cloud computing service (or an aggregation of multiple cloud resources) may be generally referred to as the "Cloud". Cloud storage may include a model of networked computer data storage where data is stored on multiple virtual servers, rather than being hosted on one or more dedicated servers. Data transfer can be encrypted and can be done via the Internet using any appropriate firewalls, as suitable for the data collected.

Figure 12A:
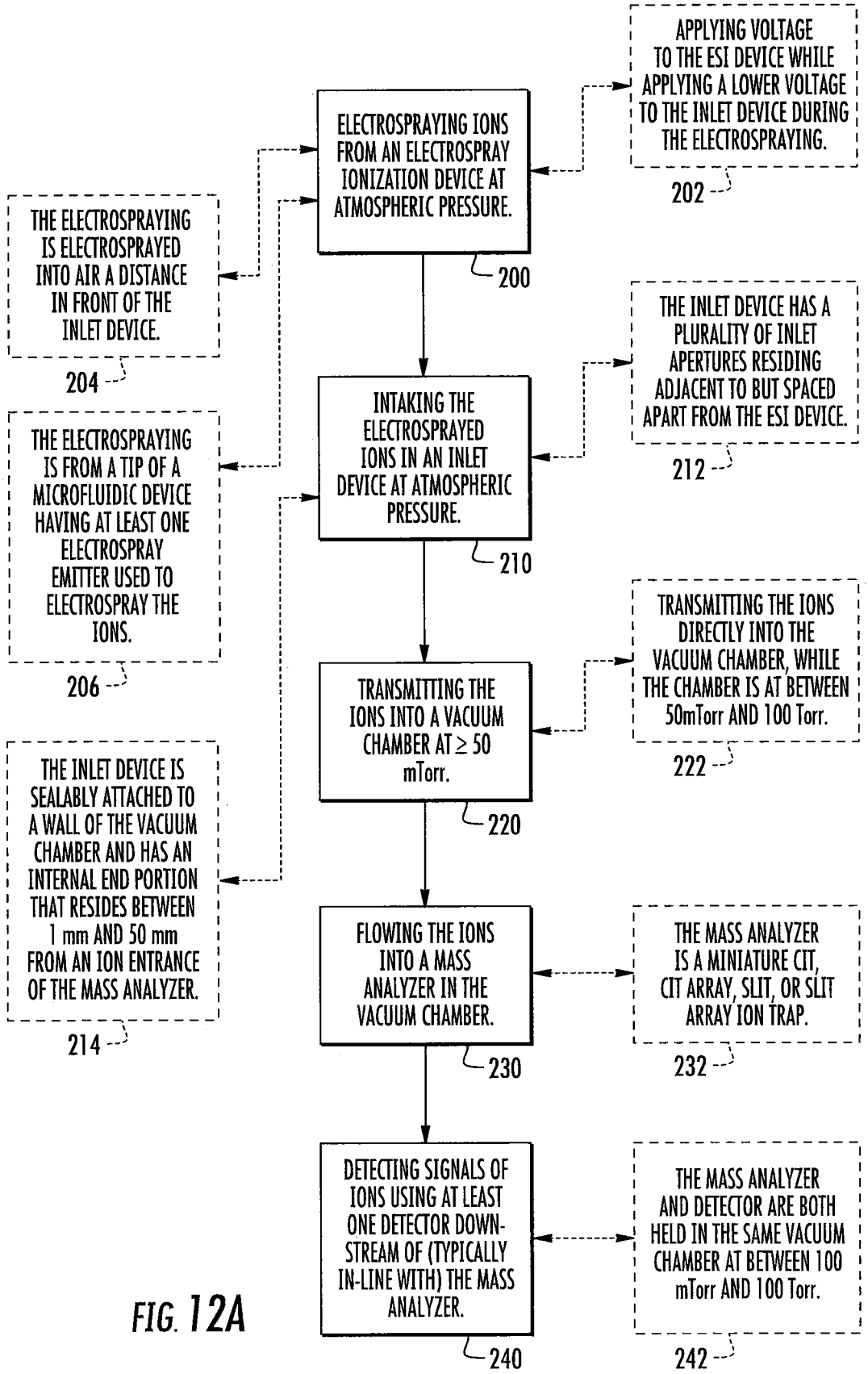
FIG. 12A is a flow chart of operations that can be used to operate a mass spectrometry system according to embodiments of the present invention.

FIG. 12A is a flow chart of exemplary actions that can be carried out to analyze a sample according to some embodiments. Ions from an electro spray ionization device are electrosprayed into a spatial region at ambient (i.e., atmospheric) pressure (block 200). The electrosprayed ions are intaken in an inlet device at ambient (i.e., atmospheric) pressure (block 210). The ions are transmitted into a vacuum chamber at about 50 mTorr or greater (block 220) and are flowed into a mass analyzer in the vacuum chamber (block 230). Signal from ions are detected using at least one detector downstream of (typically in-line with) the mass analyzer (block 240).

Voltage can be applied to the ESI Device while applying a lower voltage to the inlet device during the electrospraying (block 202).

The electrospraying occurs into air a distance in front of the inlet device (block 204).

The electrospraying is from a tip of a microfluidic device having at least one electrospray emitter used to electrospray the ions (block 206).

The inlet device can have a plurality of inlet apertures residing adjacent to but spaced apart from the ESI device (block 212).

The inlet device is sealably attached to a wall of the vacuum chamber and has an internal end portion that resides between about 1 mm and about 50 mm from an ion entrance of the mass analyzer (block 214).

The ions are directly transmitted into the vacuum chamber while the vacuum chamber is between 50 mTorr and 100 Torr (block 222).

The mass analyzer can comprise a miniature CIT ion trap (block 232).

The mass analyzer and detector can both held in the same vacuum chamber which can be at between 100 mTorr and 10 Torr (block 242).

Figure 12B:
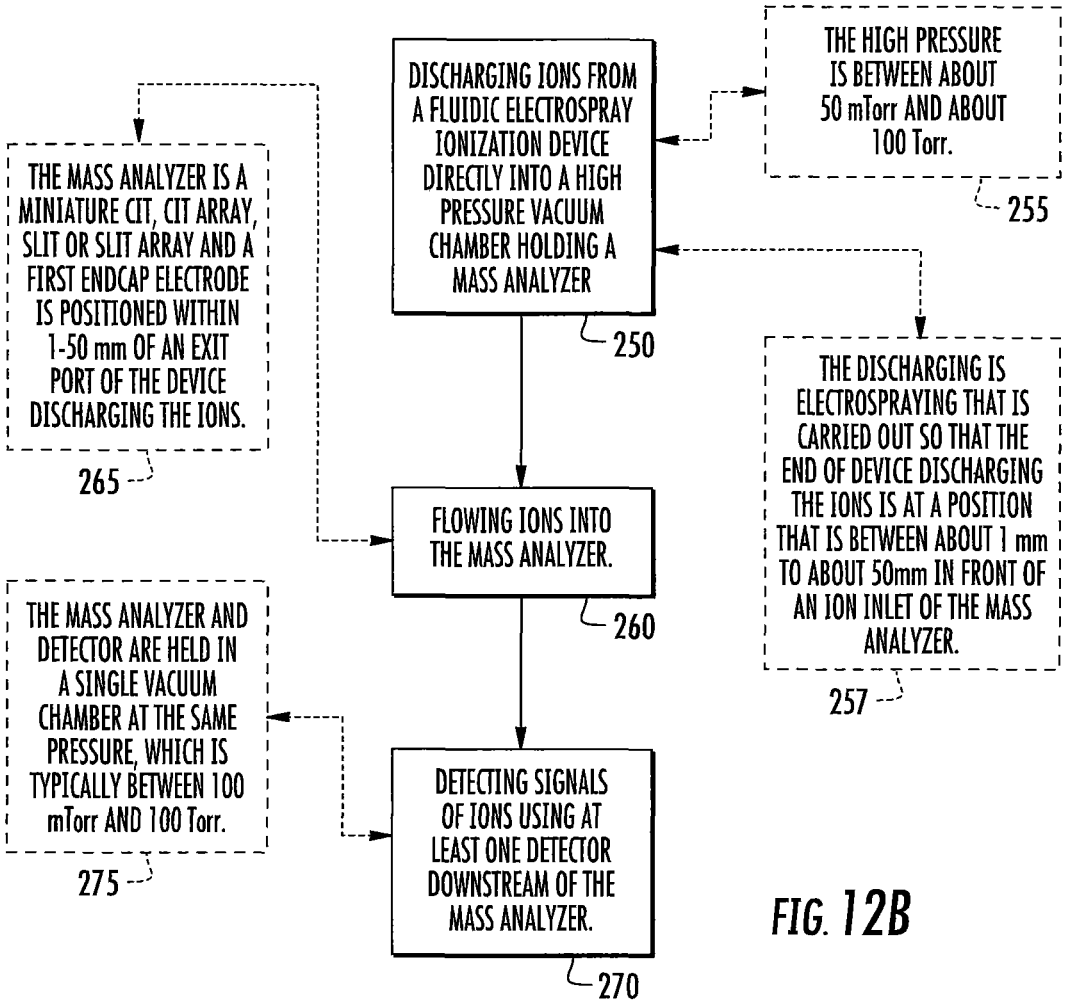
FIG. 12B is another flow chart of operations that can be used to operate a mass spectrometry system according to embodiments of the present invention.

FIG. 12B is another flow chart of exemplary actions that can be carried out to analyze a sample according to some embodiments. Ions from a fluidic capillary electrophoresis device are directly discharged (e.g., electrosprayed) into a high pressure vacuum chamber holding a mass analyzer (block 250). The ions then flow into a mass analyzer in the vacuum chamber (block 260). Signal from ions are detected using at least one detector downstream of (typically in-line with) the mass analyzer (block 270).

The high pressure can, in some embodiments, be between about 50 mTorr and 100 Torr (block 255), and in typical embodiments is between about 100 mTorr and about 10 Torr.

Discharging can occur by electrospraying so that an end of the device discharging the ions in the vacuum chamber is at a position that is between about 1 mm to about 50 mm (and can be between about 1-10 mm or between about 1-20 mm, in some embodiments) in front of an ion inlet of the mass analyzer (block 257).

The mass analyzer can be a miniature CIT, CIT array, SLIT or SLIT array and a first endcap electrode can be positioned within about 1-50 mm in front of an exit port of the ions of the device discharging the ions (block 265).

The mass analyzer and detector can be held in a single vacuum chamber at the same high pressure, which is typically between about 50 mTorr and 100 Torr (block 275).

Figure 13:
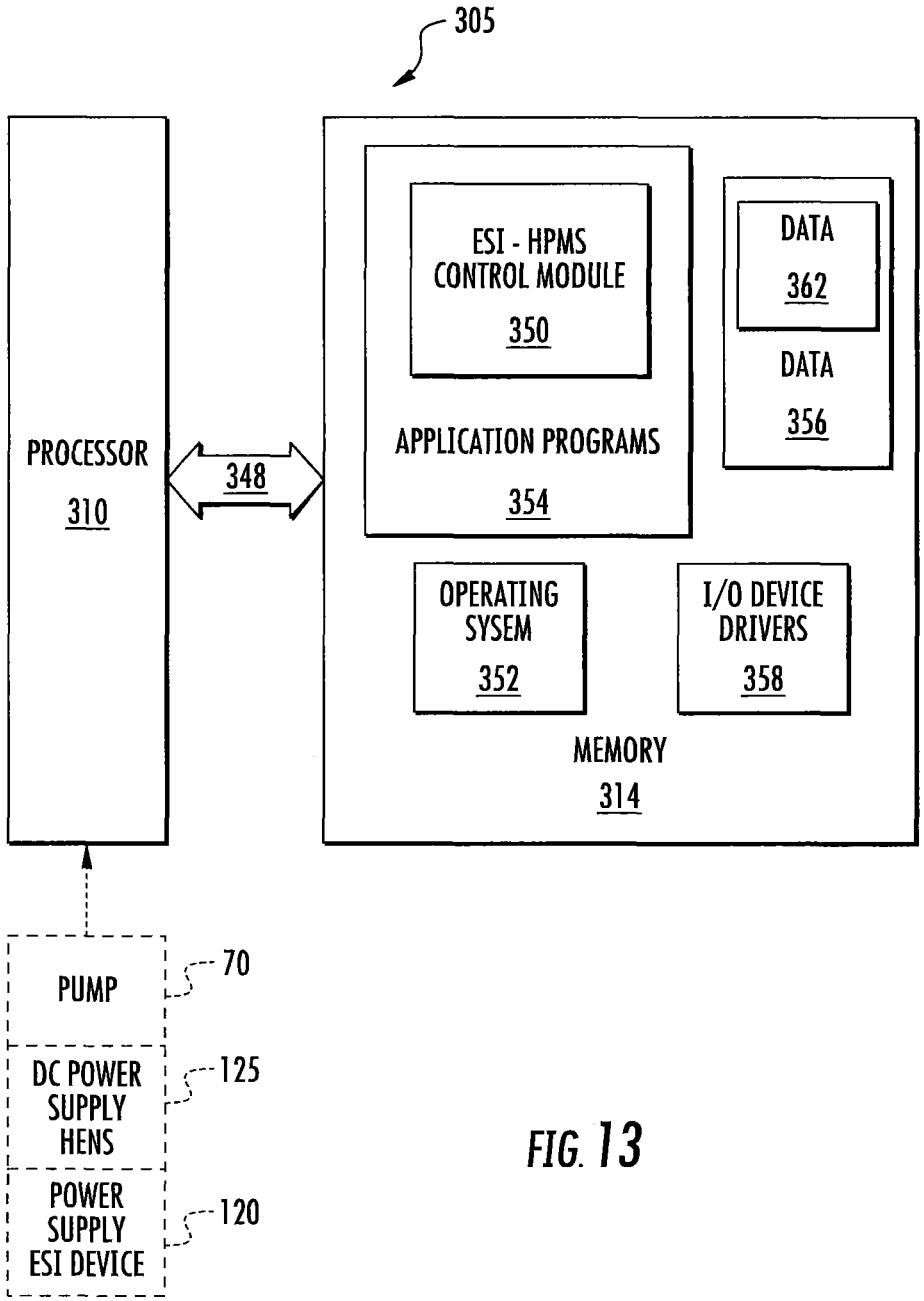
FIG. 13 is a block diagram of a data processing system according to embodiments of the present invention.

FIG. 13 is a block diagram of exemplary embodiments of data processing systems 305 that illustrates systems, methods, and computer program products in accordance with embodiments of the present invention. The processor 310 communicates with the memory 314 via an address/data bus 348. The processor 310 can be any commercially available or custom microprocessor. The processor 310 can be processor 100*p*. The memory 314 is representative of the overall hierarchy of memory devices containing the software and data used to implement the functionality of the data processing system 305. The memory 314 can include, but is not limited to, the following types of devices: cache, ROM, PROM, EPROM, EEPROM, flash memory, SRAM, and DRAM.

As shown in FIG. 13, the memory 314 may include several categories of software and data used in the data processing system 305: the operating system 352; the application programs 354; the input/output (I/O) device drivers 358; an ESI-Mass Spectrometer Control Module 350; and the data 356. The Module 350 can be onboard the mass spectrometer or remote or partially onboard and partially remote (e.g., in one or more servers, local or onboard or remote processor). The Module 350 can communicate with the DC voltage power supply 125 for the ESI to MS inlet device 15 and/or the power supply 120 for the ESI device 20.

As will be appreciated by those of skill in the art, the operating system 352 may be any operating system suitable for use with a data processing system, such as OS/2, AIX or OS/390 from International Business Machines Corporation, Armonk, N.Y., WindowsCE, WindowsNT, Windows95, Windows98, Windows2000 or WindowsXP from Microsoft Corporation, Redmond, Wash., PalmOS from Palm, Inc., MacOS from Apple Computer, UNIX, FreeBSD, or Linux, proprietary operating systems or dedicated operating systems, for example, for embedded data processing systems.

The I/O device drivers 358 typically include software routines accessed through the operating system 352 by the application programs 354 to communicate with devices such as I/O data port(s), data storage 356 and certain memory 314 components and/or the image acquisition system 320. The application programs 354 are illustrative of the programs that implement the various features of the data processing system 305 and can include at least one application, which supports operations according to embodiments of the present invention. Finally, the data 356 represents the static and dynamic data used by the application programs 354, the operating system 352, the I/O device drivers 358, and other software programs that may reside in the memory 314.

While the present invention is illustrated, for example, with reference to the Module 350 being an application program in FIG. 13, as will be appreciated by those of skill in the art, other configurations may also be utilized while still benefiting from the teachings of the present invention. For example, the Module 350 may also be incorporated into the operating system 352, the I/O device drivers 358 or other such logical division of the data processing system 305. Thus, the present invention should not be construed as limited to the configuration of FIG. 13, which is intended to encompass any configuration capable of carrying out the operations described herein.

Embodiments of the invention will be described further with respect to the non-limiting examples provided below.

EXAMPLES

Using a miniature CIT-based mass spectrometer, the feasibility of a fully miniaturized prototype CE-ESI-MS system was investigated, focusing on small biomolecules including amino acids, peptides and proteins. One application of a miniaturized CE-ESI-MS system for biomolecule analysis is monitoring of amino acids for process control of bioreactors used to produce biopharmaceuticals. Monitoring concentrations of amino acids can be used to optimize growth conditions and monitor cellular activity in a cell culture or bioreactor. Another application of this technology is the analysis of small peptides, which can be used for QA/QC of biopharmaceuticals, identification and characterization of proteins, or to gain greater insight into cellular functions. Thus, amino acids and peptides were chosen as target analytes.

Experimental

Reagents and Materials

HPLC grade acetonitrile and formic acid (99.9%) were obtained from Fisher Scientific (Fairlawn, N.J.). Purified deionized water was obtained using a Nanopure Diamond water purifier (Barnstead International, Dubuque, Iowa). (3-Aminopropyl)di-isopropylethoxysilane (APDIPES) was obtained from Gelest (Morrisville, Pa.). Amino acids used for analysis were obtained from Fisher Scientific. Peptides bradykinin, methionine-enkephalin, thymopentin, and angiotensin II were obtained from American Peptide Company (Sunnyvale, Calif.). The background electrolyte for all experiments was 50% acetonitrile, 49.9% water, and 0.1% formic acid (v/v/v, pH=3.1).

Microchip Design, Fabrication, and Operation

FIGS. 5A and 5B shows schematics of microchip designs used for CE-ESI (5A) and infusion-ESI (5B). The CE-ESI device contained four reservoirs, an injection cross, a 46-cm serpentine separation channel, an electroosmotic (EO) pump, and an ESI orifice. The reservoir labels indicate sample (S), background electrolyte (BG), sample waste (SW), and electroosmotic pump (EO). The infusion device consisted of two reservoirs (sample (S), sample plus EO pump (S, EO)) a 5.5-cm infusion channel, and an EO pump. Channel dimensions for both devices were 10 μm deep and 70 μm wide.

Microchip ESI devices were fabricated from B-270 (Telic Corp., Valencia, Calif.) glass using photolithography and wet etching techniques described in detail previously. See, J. S. Mellors, V. Gorbounov, R. S. Ramsey, and J. M. Ramsey, *Anal. Chem.,* 2008, 80, 6881-6887; and N. G. Batz, J. S. Mellors, J. P. Alarie, and J. M. Ramsey, *Anal. Chem.,* 2014, 86, 3493-3500. Devices were coated with APDIPES via chemical vapor deposition (CVD) using a LabKote CVD system (Yield Engineering Systems, Livermore, Calif.). Id. The pumping channels were then functionalized with a 20 kDa polyethylene glycol (PEG) reagent (NanoCS, Boston, Mass.). The PEG reagent terminates with an N-hydroxysuccinimide ester that reacts with the primary amine of the APDIPES surface, forming a covalent bond between the PEG chain and the surface coating.

Both CE-ESI and infusion designs were operated by application of voltages to the reservoirs via platinum wire electrodes. Applied voltages were controlled by a custom HV power supply consisting of five independent voltage modules. Three modules had a maximum output of −25 kV, and the other two had a maximum output of +10 kV (UltraVolt Inc., Ronkonkoma, N.Y.). The power supply was connected to a computer via a SCB-68 breakout box and a PCI-6713, 8-channel analog card (National Instruments, Austin, Tex.). A custom LabVIEW program was used to operate the power supply. For CE-ESI, the voltages applied to the S, B, SW, and EO reservoirs were −14, −14, −12, and +6 kV, respectively. To perform a gated injection, voltages were switched to −14, −13, −13, and +6 kV for 0.5 seconds. This produced an electric field strength of 400 V/cm with an approximate flow rate of 165 nL/min For infusion-ESI, typical voltages were +5 kV at the S reservoir and +0.5 kV for the EO reservoir.

ESI-MS

Miniature mass spectrometry (ESI-MASS SPECTROMETER) experiments were performed with a custom atmospheric interface and a differentially pumped vacuum system. A schematic of a typical experimental setup is shown in FIG. 1.

The microchip-ESI device (FIGS. 5A/5B CE or Infusion) was mounted on a custom x-y-z stage and positioned approximately 5-10 mm from the inlet capillary 15 (FIG. 1). A single sided copper clad circuit board (M.G. Chemicals, Burlington, Ontario, Canada) was used to shield the ESI orifice from the voltages applied to the reservoirs (not shown). The corner of the microfluidic devices extended about 5 mm through a slit in the board. The circuit board was held at +1 kV for CE experiments and GND for infusion experiments.

The microchip device shown in FIG. 5A for capillary electrophoresis and FIG. 5B for infusion, were glass microchips. The channels were etched to a depth of 10 μm. Reservoirs are designated with circles and indicate sample (S), background electrolyte (BG), sample waste (SW), and electroosmotic pump (P). For some of the experiments, the microchip had an injection cross, a 46-cm serpentine separation channel, and an electoosmotic pumping channel. The infusion device (5B) had of a 5.5-cm channel and an electoosmotic pumping channel, and both reservoirs are filled with the same sample.

Ions (shown as the spray triangle) produced during electrospray were conducted from atmospheric pressure (760 Torr) into the first chamber of the mass spectrometer (~1 Torr, ambient air) using a custom interface. First, ions traveled through a stainless steel capillary (2) (0.01 in. ID, Valco Instruments Co, Inc., Houston, Tex.), to which a voltage was applied, typically between +100 and +250 V. The capillary was held in place by a Swagelok UltraTorr fitting (Swagelok, Inc., Solon, Ohio). Ions were then accelerated by a copper electrode (28) and focused with a single "gate" electrode (38) into the trap (30). The end of the capillary and the accelerating electrode were fixed approximately 3 mm from the gate electrode. Ions were typically accumulated for 5 ms before analysis. They were then scanned out of the trap and detected with an electron multiplier (Detech 2300, Detector Technology, Inc., Sturbridge, Mass.). A typical mass spectrum was an average of 30 to 1000 individual mass scans.

Differential pumping held the mass analyzer and detector at independent pressures. The electron multiplier used for detection operated at lower pressures (<20 mTorr). Differential pressure was provided by two sets of pumps. A dry scroll pump (SH-110, Agilent Technologies, Inc., Santa Clara, Calif.) was used on the mass analyzer-chamber (~1 Torr) and an Agilent TPS Bench turbomolecular pump (Model TV81M) backed by a dry scroll pump (SH-110) was used on the detector chamber (~10 mTorr).

Mass analysis was performed with miniature CIT electrodes wet etched by Towne Technologies, Inc. (Somerville, N.J.). Dimensions for the CITs were $r_0$=250 μm, $z_0$=325 μm, and endcaps with 200 μm hole diameter. Each ring electrode contained a single trap. Traps were assembled by manual alignment using alignment pins. Electrodes were mounted to a custom plate with 125 μm kapton (polyimide) spacers between them. Drive RF waveforms were applied by a Rohde and Schwarz SMB 100A signal generator and amplified using a Mini Circuits TVA-R5-13 preamplifier and AR305 power amplifier. The signal was resonated with a tank circuit, and applied frequencies ranged from 7 to 12 MHz. Custom LabVIEW software was designed to monitor, control, and collect data. A National Instrument PXIe-1073 data acquisition chassis is used to interface the electronics and LabVIEW software.

For comparison of CE separation detection, a Synapt G2 quadrupole-ion mobility-time-of-flight mass spectrometer (Waters Corporation, Milford, Mass.) was used. The Sypnapt G2 was operated at a rate of 90 ms per summed with an interscan delay of 24 ms (~10 Hz). The mass range was set to 300 to 1600 m/z. MassLynx software was used to collect data and triggered by a custom LabVIEW program used to control voltages applied to the microchip.

Atmospheric Interface Development

The interface developed for mass spectrometer has several advantages over conventional ESI-MS interfaces. mass spectrometer minimizes the complexity of the atmospheric interface. Traditional ESI-MS interfaces consist of an atmospheric inlet, multiple regions of differential pressure, and complex ion optics—required due to the low-pressure operation of the mass analyzer. Because mass spectrometer operates with pressures close to 1 Torr, the interface used introduced ions directly from atmosphere into the mass analyzer chamber via a capillary inlet. A simple fitting was used to hold the capillary, so the inlet was easily removable for cleaning. Finally, minimal optics were required to maximize ion transmission due to a shorter ion-source-to-mass-analyzer distance.

Figure 14:
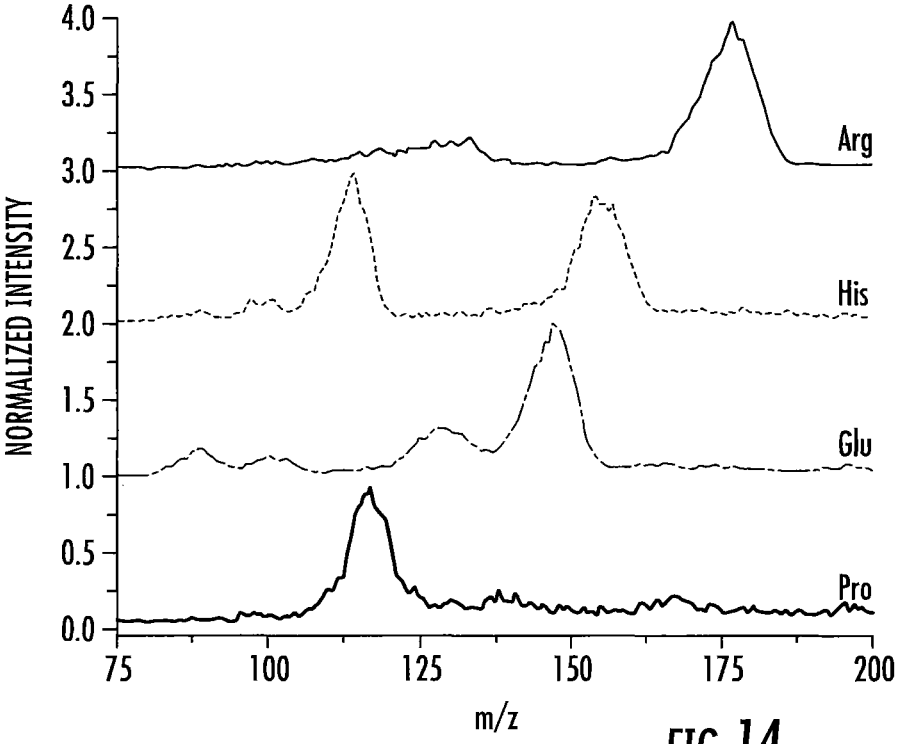
FIG. 14 is a graph of normalized intensity versus mass-to-charge ratio (m/z) of HPMS (1.2 Torr) infusion-ESI spectra of four amino acids (100 μM) with an atmospheric interface according to embodiments of the present invention.

Twenty of the common amino acids were chosen as the model analytes for the development of the microchip to MS interface. The Infusion-ESI microchip was used in development of the interface so a constant source of ions was present. Representative Infusion-ESI-MS spectra of four amino acids (arginine, histidine, glutamic acid and proline) collected using the atmospheric interface and differential chamber setup are shown in FIG. 14. Mass analysis was performed at a pressure of 1.2 Torr with ambient air as the buffer gas at a drive frequency of 10.2 MHz. Each spectrum is an average of 1000 individual mass spectral scans. The $(M+H)^+$ peak of each amino acid is clearly detected, which provides sufficient information for identification of these species. In the case of histidine and glutamic acid, some fragmentation is also observed. ESI is a soft ionization technique, but operation at high pressures results in increased ion-buffer gas collisions, which can impart the energy required to induce fragmentation. These fragmentation patterns may aid in the identification of chemical species, including the differentiation of isobars. Detection of the twenty common amino acids demonstrates the ability to detect a wide range of analytes varying in size, polarity, and basicity.

Figure 15:
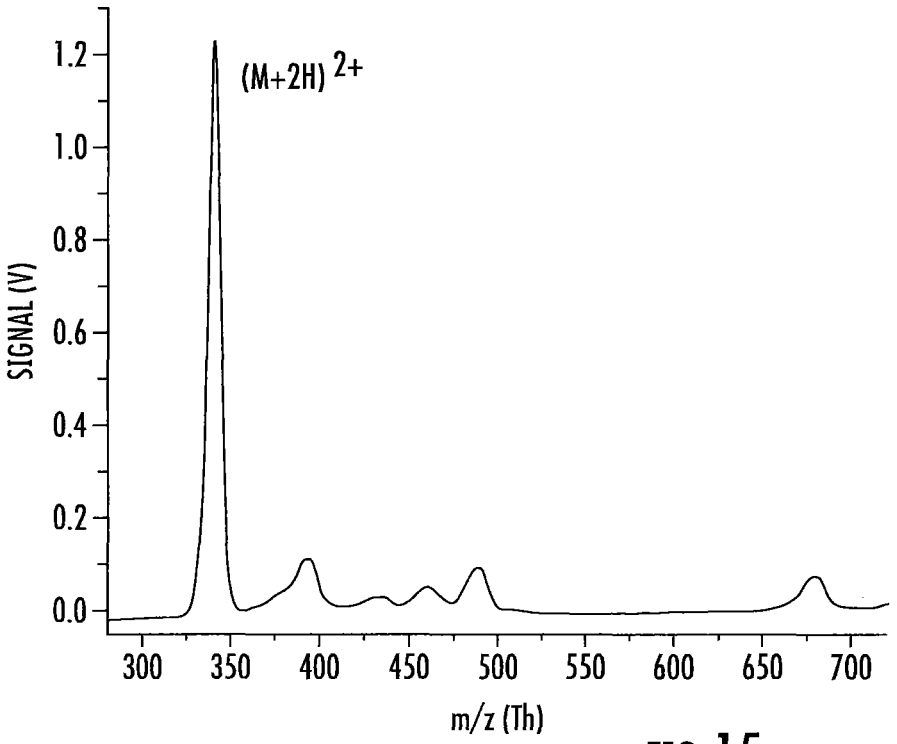
FIG. 15 is a graph of HPMS (1.3 Torr) infusion-ESI spectra of 5 μM thymopentin (V) versus (m/z) (Th) using a mini-CIT ($r_0$=250 μm), ambient air as the buffer gas, according to embodiments of the present invention.

Mass analysis with higher mass analytes was also demonstrated. An infusion-ESI-MS spectrum of a small peptide, thymopentin (RKDVY, $(M+H)^+$ m/z=681), is shown in FIG. 15. Mass analysis was performed at a pressure of 1.3 Torr in ambient air as the buffer gas and at an RF drive frequency of 7.1 MHz. Trapping and analysis of thymopentin demonstrated that the mass range of the mini-CIT could be extended to at least 681 m/z. The largest peak is the doubly protonated species, $(M+2H)^{2+}$. Under the acidic experimental conditions, this is expected due to the two basic residues present in thymopentin (R and K). In addition, the signal-to-noise ratio (S/N) for thymopentin was significantly greater than the S/N observed for the amino acids. The smaller S/N observed for amino acids versus peptides could be due to less efficient capture of small molecules due to scattering before entering the trap. Despite the difference in S/N between analytes, this simple inlet interface is an effective way of introducing ions from atmospheric pressure into vacuum.

CE-ESI-MS of Peptides

Figure 16:
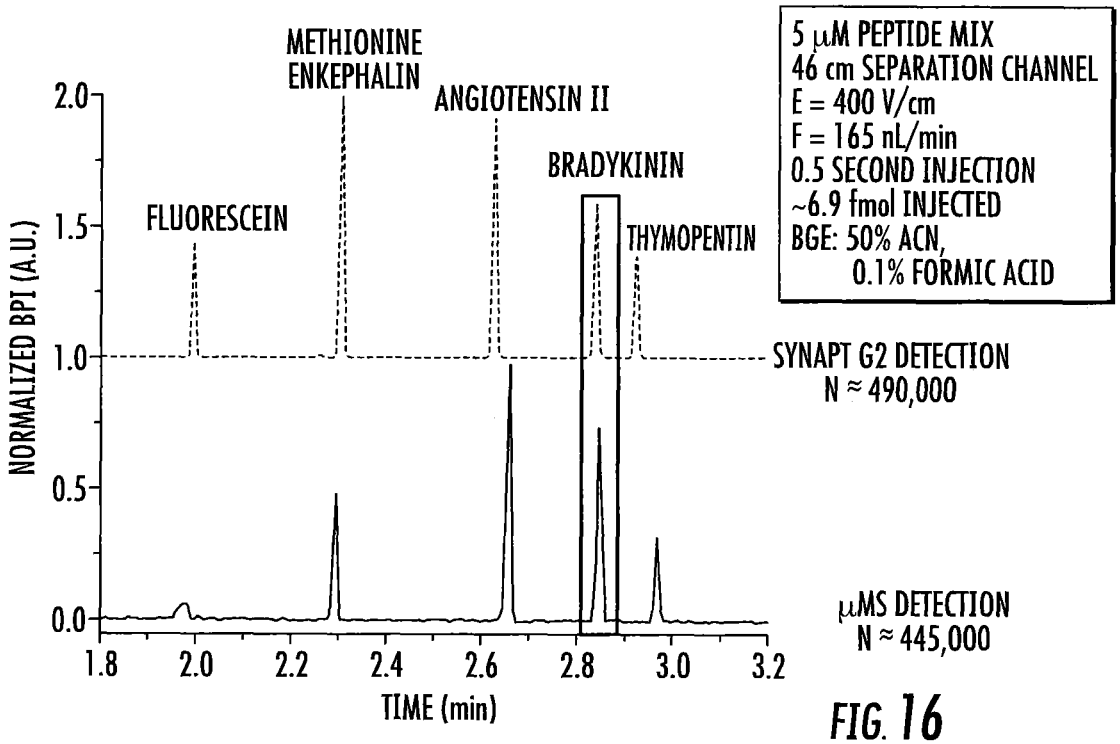
FIG. 16 is an electropherogram of normalized BPI (arbitrary units) versus time (minutes) comparing signal from Synapt G2 detection with signal from ESI-HPMS for 5 μM peptide mix according to embodiments of the present invention.

After demonstrating the viability of the atmospheric interface, the miniature CIT system was assessed as a detector for CE separations and compared with a commercial system, the Waters Synapt G2. FIG. 16 shows base peak intensity (BPI) electropherograms of a standard peptide mixture (methionine enkephalin, angiotensin II, bradykinin, and thymopentin) detected with the mini-CIT system and the Synapt G2. Fluorescein was added to the mixture as a dead time marker. Migration times are different due to slightly different field strengths.

The separation field strength was 400 V/cm with a flow rate of about 165 nL/min. Approximately 7 fmol of peptide mixture was injected during a 0.5 s gated injection. The mini-CIT ($r_0$=250 μm) was operated at 1.2 Torr with an RF drive frequency of 7.1 MHz. The four peptides and fluorescein were separated and detected. The calculated separation efficiencies for these separations were approximately 445,000 theoretical plates for the mini-CIT and 490,000 theoretical plates for the Synapt G2. Both mass spectrometers were able to detect these fast and highly efficient separations, with the discrepancy in calculated efficiency resulting from differences in mass spectral sampling rate. The Synapt G2 collected spectra at about 10 Hz, while the mini-CIT collected spectra at about 3 Hz. The CIT is limited by the time required to accumulate, analyze, and clear ions from the trap. With sensitivity improvements, the accumulation time can likely be minimized and the sampling rate increased. Fluorescein proved not as easily detected with the mini-CIT but could easily be replaced with another dead time marker. Detection of these peptides following CE separation shows that a miniature CIT based mass spectrometer operated at high pressure can produce comparable results to that of a commercial instrument. The Synapt G2 showed slightly better S/N, but this simple comparison demonstrates the viability of a mass spectrometer using a mini-CIT as a detector for the separation of biomolecules.

Figure 17:
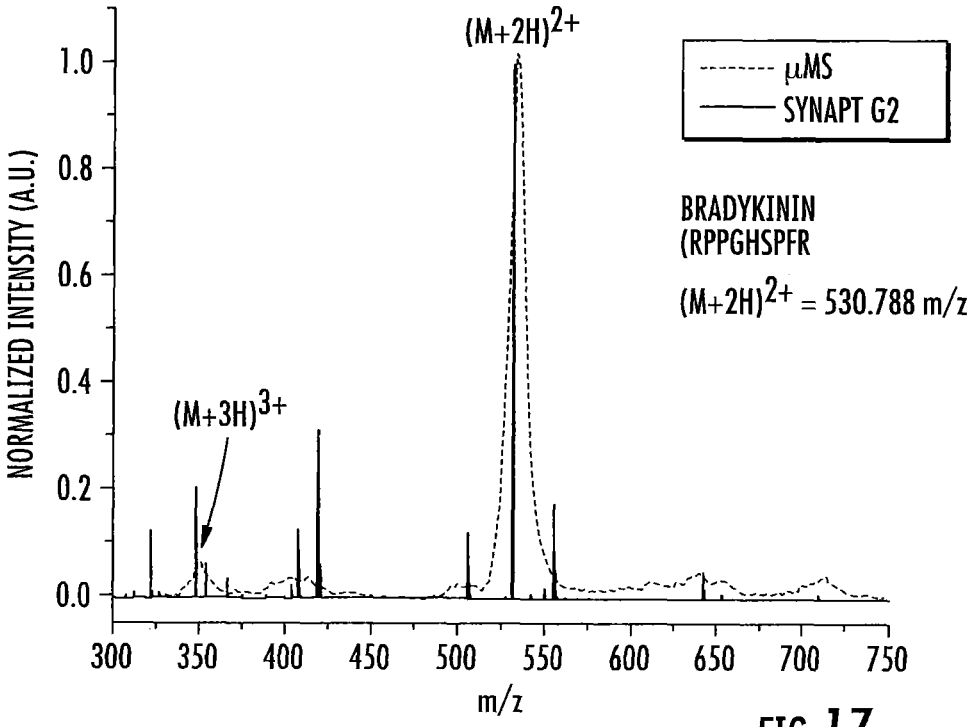
FIG. 17 is a graph of CE-ESI mass spectra (normalized intensity, arbitrary units) versus m/z comparing signal from Synapt G2 detection with signal from ESI-HPMS for Bradykinin according to embodiments of the present invention.
Figure 18:
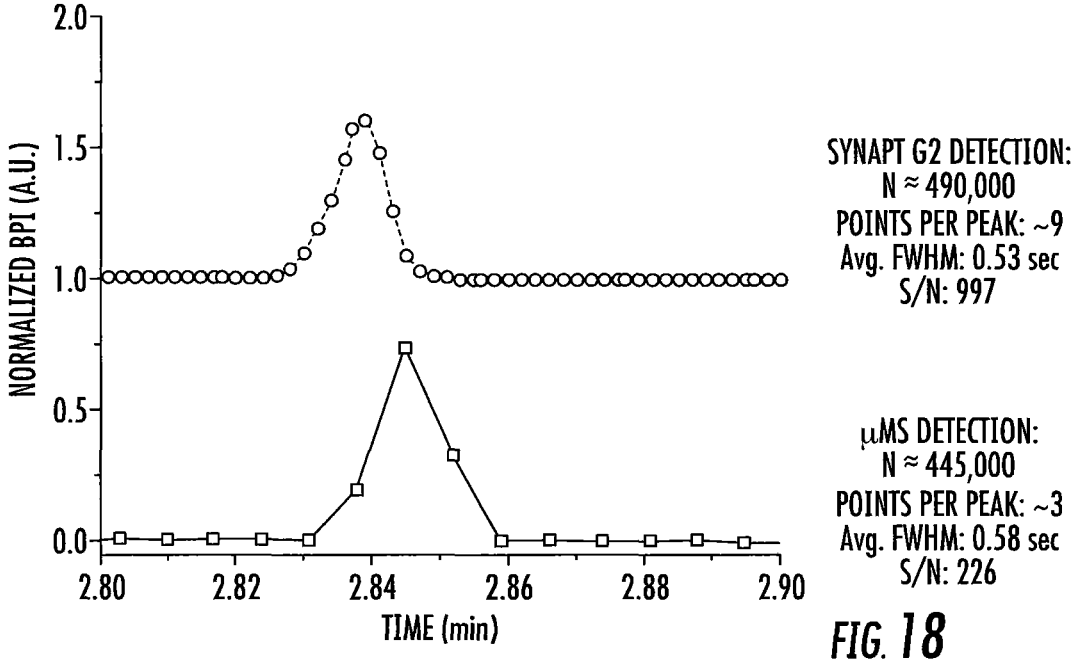
FIG. 18 is a graph of normalized BPI (arbitrary units) versus time comparing MS sampling rates for Synapt G2 detection and ESI-HPMS according to embodiments of the present invention.

For mixtures like these peptides, the mini-CIT system offers a simple and inexpensive alternative to a large commercial instrument such as the Synapt G2. The miniature MS system can provide useful mass spectral information for label-free detection and identification of chemical species. Sample mass spectra of bradykinin for both MS systems acquired during the CE separations are shown in FIG. 17. Some similar features can be observed in the two spectra, most notably the $(M+2H)^{2+}$ peaks at 531 m/z. The most obvious difference is the observed peak width (12.0 m/z with mass spectrometer; 0.026 m/z with Synapt G2). Wider peaks are expected in the mini-CIT system due to high pressure operation and air buffer gas. Peak widths have been significantly improved (<5.0 m/z) by increasing the operating drive frequency to 14.4 MHz and operating at lower buffer gas pressures. Despite the increased peak width, a mass spectrum combined with CE migration time provides sufficient information for identification of many chemical species, especially for an application where the goal is detection of known target analytes. FIG. 18 is a graph that illustrates MS sampling rates for the Synapt G2 and the mini-CIT/ES system (time versus normalized BPI, arbitrary units).

Figure 19A:
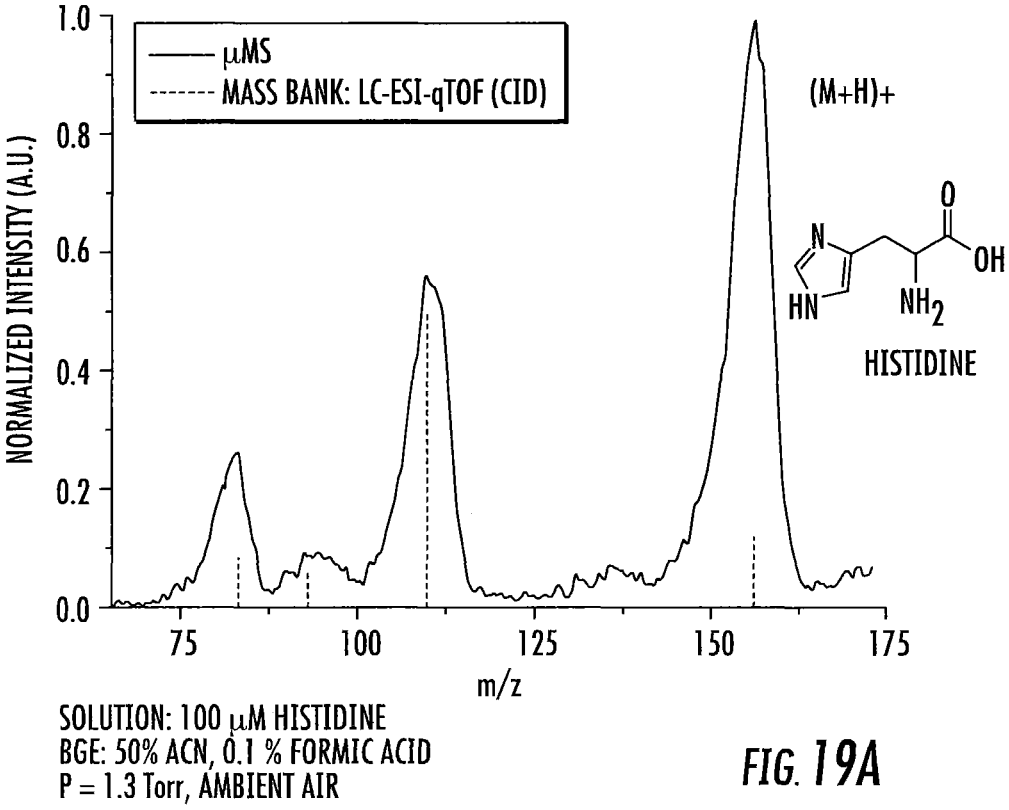
FIG. 19A is a graph of normalized intensity (arbitrary units) versus m/z fir 100 μM Histidine comparing signal from ESI-HPMS with signal from the Mass Bank; LC-ESI-qTOF (CID) according to embodiments of the present invention.
Figure 19B:
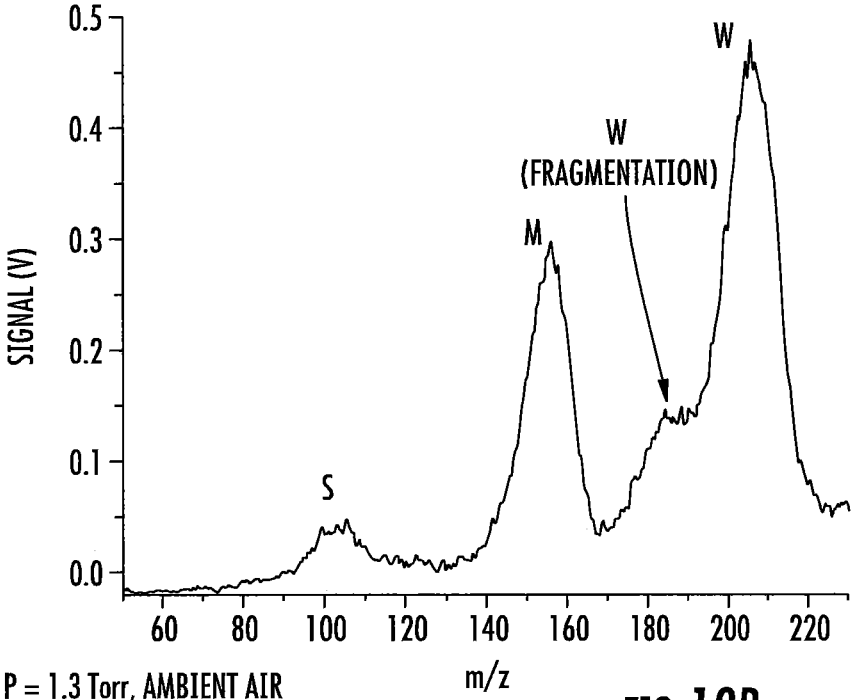
FIG. 19B is a graph of signal (V) versus m/z for infusion-ESI of amino acid mixture (S, W, and M) for ESI-HPMS (1.3 Torr) with ambient air as the buffer gas according to embodiments of the present invention.
Figure 19C:
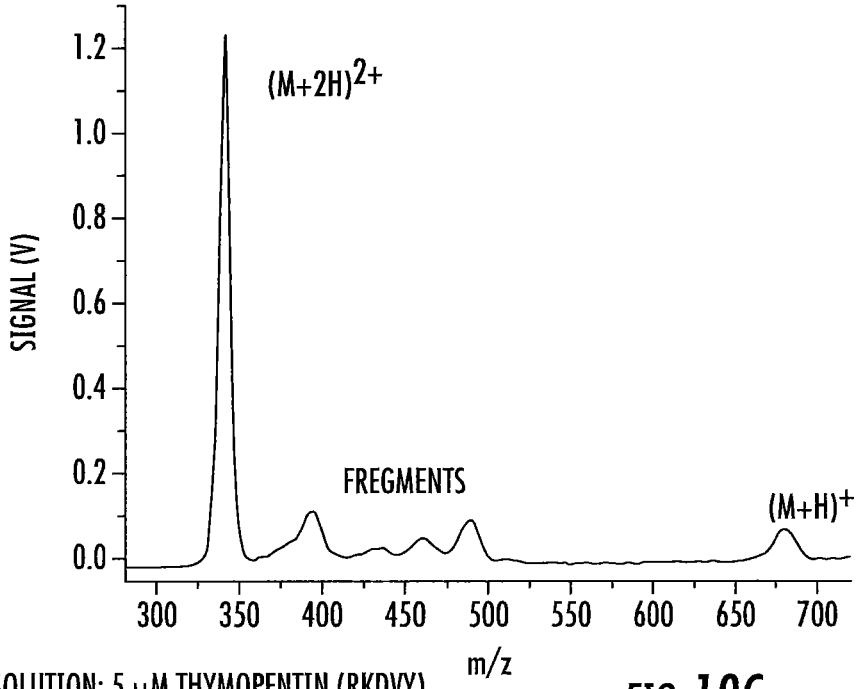
FIG. 19C is a graph of signal (V) versus m/z for infusion-ESI of a peptide for ESI-HPMS (1.3 Torr) with ambient air as the buffer gas according to embodiments of the present invention.

FIGS. 19A-19C are graphs of infusion-ESI mass spectral measurements of Amino Acid, Amino Acid Mixture and a peptide, respectively. FIG. 19A also illustrates data from mass bank of the amino acid (Histidine) for comparison.

Figure 20:
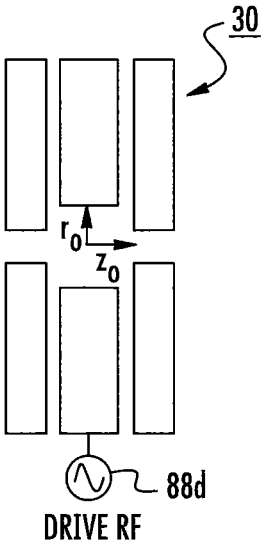
FIG. 20 is a diagram illustrating fundamental principles of operation for a cylindrical ion trap (CIT) and high pressure ion trap theory.
Figure 21:
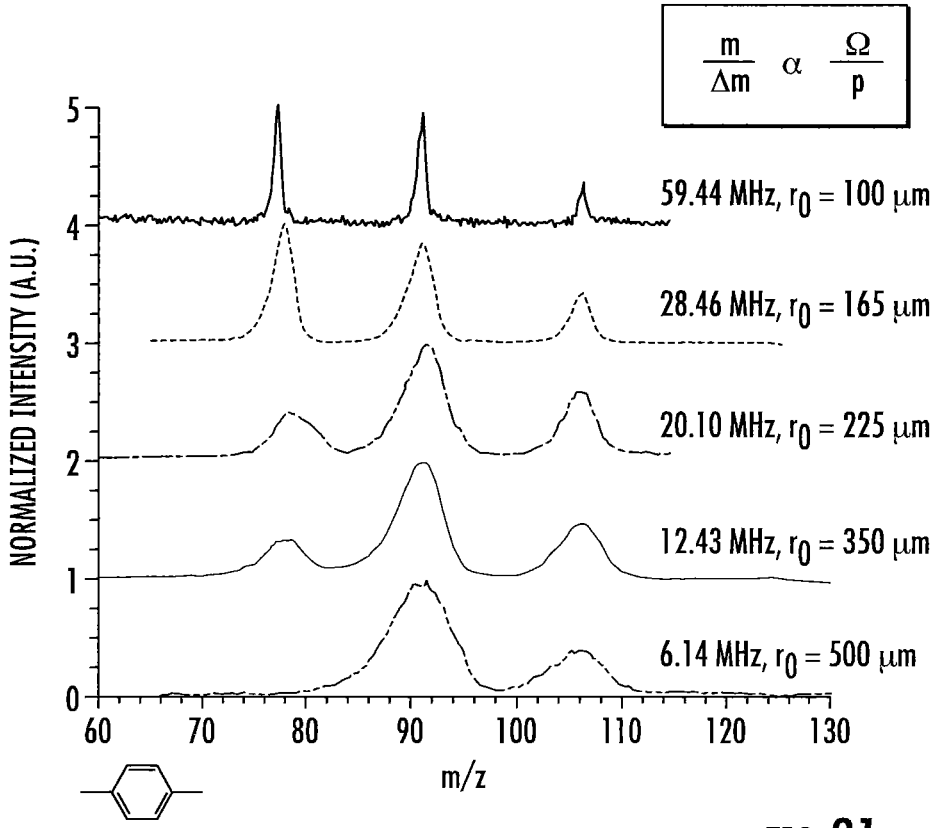
FIG. 21 is a graph of normalized intensity (arbitrary units) versus m/z for different RF drive frequencies and different critical $r_0$ values at 1.0 Torr, with ambient air as the buffer gas, according to embodiments of the present invention.

FIG. 20 is a diagram illustrating high pressure ion trap theory with operational parameters. Importantly, the resolving power of an ion trap mass spectrometer is proportional to the RF drive frequency, Ω, divided by the operating pressure, P. Thus, resolution can be recovered when P is increased by correspondingly increasing Ω. FIG. 20 also shows that the magnitude of $\chi$ required for ion ejection is inversely related to trap dimensions, $r_0$ and $z_0$. FIG. 21 is a graph showing experimental results for mass spectral resolution when using different RF frequencies and $r_0$ sizes in normalized intensity (A.U.) Resolution changes according to ion trap theory shown in FIG. 20.

In summary, a microchip electrospray ionization source can be successfully coupled to a high pressure mass spectrometer and can use an ambient, e.g, atmospheric) pressure inlet of a metallic, e.g., stainless steel, capillary and DC ion control to conduct ions into the mass spectrometer. Infusions of amino acids and peptides were performed and detected with a miniature cylindrical ion trap (mini-CIT) based mass spectrometer operated at ≥1 Torr with air as the buffer gas. Detection of thymopentin demonstrated the mass range of the mini-CIT detector could be extended to at least 681 m/z. Small proteins have also been observed using systems as described above, e.g., cytochrome C and myoglobin with masses of approximately 12 k Da and 17 k Da, respectively.

A microchip capillary electrophoresis (CE) separation with mini-CIT detection was also performed and the results compared with detection using a commercial instrument (Waters Synapt G2). Comparable separation efficiencies were observed with both mass spectrometers. Comparison of mass spectra in the two systems reveal similar features observed, but with wider peak widths in the mini-CIT (12 m/z shown, but has been improved to <5 m/z) than on the Synapt G2 (0.026 m/z) as expected due to high pressure operation.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed:

1. An electrospray ionization (ESI)-mass spectrometer analysis system, comprising:

a fluidic chip comprising an integrated fluidic channel that forms an ESI device, wherein the channel comprises an end formed at an edge of the fluidic chip, the end forming an emitter configured to electrospray ions; and a mass spectrometer in fluid communication with the and comprising:

a mass analyzer held in a vacuum chamber, wherein the vacuum chamber is configured to have a high pressure of about 50 mTorr or greater during operation;

a detector in communication with the mass analyzer; and a sealing member configured to receive the edge of the fluidic chip to seal the fluidic chip to a wall of the vacuum chamber, wherein, during operation of the system, the ESI device electrosprays ions directly into the vacuum chamber with the mass analyzer.

2. The system of claim 1, wherein the fluidic chip is supported by the wall of the vacuum chamber when the edge is received by the sealing member.

3. The system of claim 1, wherein the sealing member is configured to receive multiple edges of the fluidic chip as the edge.

4. The system of claim 1, wherein the sealing member is configured to receive a corner of the fluidic chip as the edge.

5. The system of claim 4, wherein the end of the channel is positioned at, or in proximity to, the corner of the fluidic chip.

6. The system of claim 1, wherein an opening in the sealing member conforms to a shape of a portion of the fluidic chip.

7. The system of claim 1, wherein an opening in the sealing member has a rectangular cross-sectional shape.

8. The system of claim 1, wherein the sealing member is positioned in the wall of the vacuum chamber.

9. The system of claim 1, wherein the sealing member is coupled to the fluidic chip.

10. The system of claim 9, wherein the end of the fluidic chip extends through the sealing member.

11. The system of claim 9, wherein the wall of the vacuum chamber comprises an aperture dimensioned to receive the sealing member.

12. The system of claim 1, wherein during operation of the system, the sealing member is positioned in the wall of the vacuum chamber, and the mass spectrometer comprises a plurality of electrodes positioned adjacent to the sealing member, each member of the plurality of electrodes comprising an aperture through which ions pass, wherein cross-sectional sizes of the apertures decrease in a direction away from the sealing member and toward the detector.

13. The system of claim 12, wherein the plurality of electrodes form an ion funnel.

14. An electrospray ionization (ESI)-mass spectrometer analysis system, comprising:

a fluidic chip comprising a fluidic channel, wherein the channel comprises an aperture forming an emitter configured to electrospray ions; and a mass spectrometer in fluid communication with the emitter and comprising:

a mass analyzer held in a vacuum chamber, wherein the vacuum chamber is configured to have a high pressure of about 50 mTorr or greater during operation;

a detector in communication with the mass analyzer; and a sealing member configured to receive multiple edges of the fluidic chip to seal the fluidic chip to a wall of the vacuum chamber, wherein, during operation of the system, the emitter electrosprays ions directly into the vacuum chamber with the mass analyzer.

15. An electrospray ionization (ESI)-mass spectrometer analysis system, comprising:

a fluidic chip comprising a fluidic channel, wherein the channel comprises an aperture forming an emitter configured to electrospray ions; and a mass spectrometer in fluid communication with the emitter and comprising:

a mass analyzer held in a vacuum chamber, wherein the vacuum chamber is configured to have a high pressure of about 50 mTorr or greater during operation;

a detector in communication with the mass analyzer;

a sealing member configured to receive an edge portion of the fluidic chip to seal the fluidic chip to a wall of the vacuum chamber; and a plurality of electrodes positioned adjacent to the sealing member, each member of the plurality of electrodes comprising an aperture through which ions pass, wherein cross-sectional sizes of the apertures decrease in a direction away from the sealing member and toward the detector, wherein, during operation of the system, the emitter electrosprays ions directly into the vacuum chamber with the mass analyzer.

* * * * *